US012072107B2

(12) United States Patent
Porwal et al.

(10) Patent No.: US 12,072,107 B2
(45) **Date of Patent: *Aug. 27, 2024**

(54) WATER HEATERS WITH REAL-TIME HOT WATER SUPPLY DETERMINATION

(71) Applicant: Rheem Manufacturing Company, Atlanta, GA (US)

(72) Inventors: Piyush Porwal, Montgomery, AL (US); Shreya Gharia, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 167 days.

This patent is subject to a terminal disclaimer.

(21) Appl. No.: 17/705,529

(22) Filed: Mar. 28, 2022

(65) Prior Publication Data

US 2022/0214050 A1 Jul. 7, 2022

Related U.S. Application Data

(63) Continuation of application No. 16/527,873, filed on Jul. 31, 2019, now Pat. No. 11,287,144.

(51) Int. Cl.
*F24D 19/10* (2006.01)
*F24H 9/20* (2022.01)
(Continued)

(52) U.S. Cl.
CPC ..... *F24D 19/1006* (2013.01); *F24D 19/1063* (2013.01); *F24H 9/2007* (2013.01);
(Continued)

(58) Field of Classification Search
CPC ..... F24D 19/1006; F24D 19/1048; F24D 19/1063; F24D 19/1081; F24D 19/2007;
(Continued)

(56) References Cited

U.S. PATENT DOCUMENTS 5,808,277 A * 9/1998 Dosani ..... F24H 15/486 219/486
5,956,462 A 9/1999 Langford
(Continued)

FOREIGN PATENT DOCUMENTS

CN 102374647 A 3/2012
CN 104833103 A 8/2015
(Continued)

OTHER PUBLICATIONS

First Office Action issued in the corresponding Chinese Application No. 202080055299.4 dated Apr. 21, 2023, along with the English translation. (22 pages).
(Continued)

*Primary Examiner* — Steven B McAllister
*Assistant Examiner* — John E Bargero
(74) *Attorney, Agent, or Firm* — Eversheds Sutherland (US) LLP

(57) ABSTRACT

A water heating system can include a water heater having a tank, and a first temperature sensor disposed toward a top end of the tank to measure a first temperature and a second temperature sensor disposed toward a bottom end of the tank to measure a second temperature. The water heating system can further include a controller communicably coupled to the first temperature sensor and the second temperature sensor, where the controller determines an amount of heated water in the tank based on a plurality of algorithms and measurements made by the first and second temperature sensors. The plurality of algorithms solves for at least one calculated temperature for at least one point between a first location of the first temperature sensor and a second location of the second temperature sensor, where the at least one calculated temperature is used to determine the amount of heated water in the tank.

20 Claims, 13 Drawing Sheets

(51) Int. Cl.

| | |
|---|---|
| ***F24H 15/225*** | (2022.01) |
| ***F24H 15/355*** | (2022.01) |
| ***F24H 15/421*** | (2022.01) |
| ***F24H 15/457*** | (2022.01) |
| ***F24H 15/464*** | (2022.01) |
| *F24H 15/12* | (2022.01) |
| *F24H 15/156* | (2022.01) |
| *F24H 15/174* | (2022.01) |
| *F24H 15/238* | (2022.01) |
| *F24H 15/242* | (2022.01) |
| *F24H 15/269* | (2022.01) |
| *F24H 15/281* | (2022.01) |
| *F24H 15/31* | (2022.01) |
| *F24H 15/395* | (2022.01) |
| *F24H 15/486* | (2022.01) |

(52) U.S. Cl.

CPC ..... *F24H 15/225* (2022.01); *F24H 15/355* (2022.01); *F24H 15/421* (2022.01); *F24H 15/457* (2022.01); *F24H 15/464* (2022.01); *F24D 2220/042* (2013.01); *F24D 2220/048* (2013.01); *F24D 2240/20* (2013.01); *F24D 2240/22* (2013.01); *F24D 2240/24* (2013.01); *F24D 2240/243* (2013.01); *F24D 2240/26* (2013.01); *F24H 15/12* (2022.01); *F24H 15/156* (2022.01); *F24H 15/174* (2022.01); *F24H 15/238* (2022.01); *F24H 15/242* (2022.01); *F24H 15/269* (2022.01); *F24H 15/281* (2022.01); *F24H 15/31* (2022.01); *F24H 15/395* (2022.01); *F24H 15/486* (2022.01)

(58) Field of Classification Search

CPC ..... F24D 2220/042; F24D 2220/048; F24D 2240/20; F24D 2240/22; F24D 2240/24; F24D 2240/243; F24D 2240/26; F24H 15/464; F24H 15/421; F24H 15/457; F24H 15/225; F24H 15/355; F24H 15/174; F24H 15/269; F24H 15/12; F24H 15/486; F24H 15/31; F24H 15/395; F24H 15/156; F24H 15/242; F24H 15/238; F24H 15/281

USPC ..... 237/8 D, 8 A, 81; 239/99 E, 94

IPC ..... F24D 19/10

See application file for complete search history.

(56) References Cited

U.S. PATENT DOCUMENTS

| | | | | |
|---|---|---|---|---|
| 7,021,073 | B2 * | 4/2006 | Sakakibara | F24H 15/174 62/238.7 |
| 7,027,724 | B2 | 4/2006 | Baxter | |
| 7,712,677 | B1 | 5/2010 | Munsterhuis et al. | |
| 7,740,987 | B2 | 6/2010 | Miyauchi et al. | |
| 8,069,013 | B2 | 11/2011 | Hotton et al. | |
| 9,170,030 | B2 | 10/2015 | Nagata et al. | |
| 9,390,381 | B2 | 7/2016 | Davari et al. | |
| 9,400,122 | B2 | 7/2016 | Kim et al. | |
| 9,671,116 | B2 | 6/2017 | Sugimoto et al. | |
| 11,287,144 | B2 * | 3/2022 | Porwal | F24D 19/1081 |
| 11,293,667 | B2 * | 4/2022 | Porwal | F24H 15/355 |
| 11,828,493 | B2 * | 11/2023 | Porwal | F24D 17/0031 |
| 2004/0161227 | A1 * | 8/2004 | Baxter | F24H 15/132 392/454 |
| 2005/0019631 | A1 | 1/2005 | Miyauchi et al. | |
| 2005/0022542 | A1 | 2/2005 | Sakakibara | |
| 2005/0147401 | A1 * | 7/2005 | Baxter | F24H 15/37 392/454 |
| 2005/0147402 | A1 * | 7/2005 | Baxter | F24H 15/486 392/454 |
| 2005/0268865 | A1 * | 12/2005 | Valbh | G05D 23/1904 122/14.1 |
| 2006/0257127 | A1 | 11/2006 | Patterson et al. | |
| 2007/0175883 | A1 | 8/2007 | Miu et al. | |
| 2009/0084329 | A1 | 4/2009 | Matsuoka et al. | |
| 2009/0226155 | A1 * | 9/2009 | Cartwright | F24H 15/225 392/485 |
| 2009/0239108 | A1 * | 9/2009 | Miyauchi | H01M 8/04029 429/437 |
| 2010/0004790 | A1 | 1/2010 | Harbin, III et al. | |
| 2010/0037889 | A1 * | 2/2010 | Gordon | F24D 11/003 126/611 |
| 2010/0263606 | A1 * | 10/2010 | Beckett | F24D 19/1045 122/367.1 |
| 2010/0290763 | A1 * | 11/2010 | Boulay | F24H 15/223 219/494 |
| 2011/0061418 | A1 * | 3/2011 | Ishihara | F24H 15/174 165/53 |
| 2011/0123179 | A1 * | 5/2011 | Roetker | F24H 1/202 219/494 |
| 2011/0139259 | A1 | 6/2011 | Nagata et al. | |
| 2012/0054123 | A1 | 3/2012 | Broniak et al. | |
| 2012/0060771 | A1 | 3/2012 | Brian et al. | |
| 2013/0074827 | A1 | 3/2013 | Kim et al. | |
| 2013/0178992 | A1 | 7/2013 | De Graeve | |
| 2013/0193221 | A1 | 8/2013 | Buescher et al. | |
| 2013/0334330 | A1 | 12/2013 | Moon | |
| 2014/0027524 | A1 | 1/2014 | Sugimoto et al. | |
| 2015/0226460 | A1 | 8/2015 | Zemach | |
| 2016/0195284 | A1 * | 7/2016 | Chaudhry | F24H 15/25 219/494 |
| 2017/0284703 | A1 | 10/2017 | Weksler et al. | |
| 2018/0283732 | A1 | 10/2018 | Yang | |
| 2018/0292095 | A1 | 10/2018 | Lesage | |
| 2019/0024908 | A1 | 1/2019 | Chaudhry et al. | |
| 2019/0285314 | A1 * | 9/2019 | Shaffer | G05D 23/1858 |
| 2021/0033286 | A1 * | 2/2021 | Porwal | F24H 15/457 |

FOREIGN PATENT DOCUMENTS

| | | | | | |
|---|---|---|---|---|---|
| CN | 108679850 | A | | 10/2018 | |
| FR | 3029274 | A1 | | 6/2016 | |
| JP | S58130941 | A | | 8/1983 | |
| JP | S61190243 | A | | 8/1986 | |
| JP | 2003106653 | A | * | 4/2003 | F24D 17/02 |
| JP | 2005049054 | A | | 2/2005 | |
| JP | 2007132594 | A | * | 5/2007 | F24H 4/04 |
| JP | 2007285634 | A | | 11/2007 | |
| JP | 2013106653 | A | | 6/2013 | |
| WO | 2018000911 | A1 | | 1/2018 | |
| WO | 2021021976 | A1 | | 2/2021 | |

OTHER PUBLICATIONS

International Search Report issued in international application No. PCT/US2020/044143, mailed Oct. 29, 2020, 1 pp.

Extended European Search Report of the corresponding European Patent Application No. 20846426 dated Jul. 21, 2023 (9 pages).

* cited by examiner

WATER HEATERS WITH REAL-TIME HOT WATER SUPPLY DETERMINATION

CROSS-REFERENCE TO RELATED APPLICATIONS

This application is a continuation of U.S. patent application Ser. No. 16/527,873 filed 31 Jul. 2019, the entire contents and substance of which is incorporated herein by reference in its entirety as if fully set forth below.

TECHNICAL FIELD

The present disclosure relates generally to water heaters, and more particularly to systems, methods, and devices for determining, in real time, hot water supply in a storage-type water heater.

BACKGROUND

Water heaters are generally used to provide a supply of hot water. Water heaters can be used in a number of different residential, commercial, and industrial applications. A water heater can supply hot water to a number of different processes. For example, a hot water heater in a residential dwelling can be used for an automatic clothes washer, an automatic dishwasher, one or more showers, and one or more sink faucets. Every storage-type water heater has a limited capacity, and so when one or more processes use hot water at one time, there may be limited or no hot water available from the storage-type water heater until the water heater has sufficient time to heat more water.

SUMMARY

In general, in one aspect, the disclosure relates to a water heating system. The water heating system can include a water heater that includes a tank, an inlet line, and an outlet line, where the inlet line provides unheated water to the tank, and where the outlet line draws heated water from the tank. The water heating system can also include a first temperature sensor disposed toward a top end of the tank, where the first temperature sensor measures a first temperature of water toward the top end of the tank. The water heating system can further include a second temperature sensor disposed toward a bottom end of the tank, where the second temperature sensor measures a second temperature of the water toward the bottom end of the tank. The water heating system can also include a controller communicably coupled to the first temperature sensor and the second temperature sensor, where the controller determines an amount of heated water in the tank based on a plurality of algorithms and measurements made by the first temperature sensor toward the top end of the tank and the second temperature sensor toward the bottom end of the tank. The plurality of algorithms solves for at least one calculated temperature for at least one point between a first location of the first temperature sensor and a second location of the second temperature sensor along a height of the tank, where the amount of heated water in the tank is determined using the at least one calculated temperature.

In another aspect, the disclosure can generally relate to a controller that includes a control engine. The control engine can be configured to communicate with a first temperature sensor and a second temperature sensor to receive a plurality of measurements associated with heated water within a tank of a water heater, where the first temperature sensor is disposed toward a top end of the tank and measures a first temperature of water toward the top end of the tank, and where the second temperature sensor is disposed toward a bottom end of the tank and measures a second temperature of water toward the bottom end of the tank. The control engine can also be configured to determine, using the plurality of measurements and a plurality of algorithms, how much heated water is currently available within the tank of the water heater. The plurality of algorithms solves for at least one calculated temperature at a plurality of points between a first location of the first temperature sensor and a second location of the second temperature sensor along a height of the tank, where the amount of heated water in the tank is determined using the at least one calculated temperature.

In yet another aspect, the disclosure can generally relate to a non-transitory computer-readable medium comprising instructions that, when executed by a hardware processor, perform a method for determining a supply of heated water from a water heater in real-time. The method can include measuring, using a first temperature sensor disposed toward a top end of a tank of the water heater, at least one first temperature of a fluid toward the top end of the tank of the water heater, where the fluid comprises heated water. The method can also include measuring, using a second temperature sensor disposed toward a bottom end of the tank of the water heater, at least one second temperature of the fluid toward the bottom end of the tank of the water heater. The method can further include determining, using a plurality of algorithms, the at least one first temperature toward the top end of the tank, and the at least one second temperature toward the bottom end of the tank, an amount of heated water available for immediate use from the water heater. The plurality of algorithms solves for at least one calculated temperature at a plurality of points between a first location of the first temperature sensor and a second location of the second temperature sensor along a height of the tank, where the amount of heated water in the tank is determined using the at least one calculated temperature.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1A:
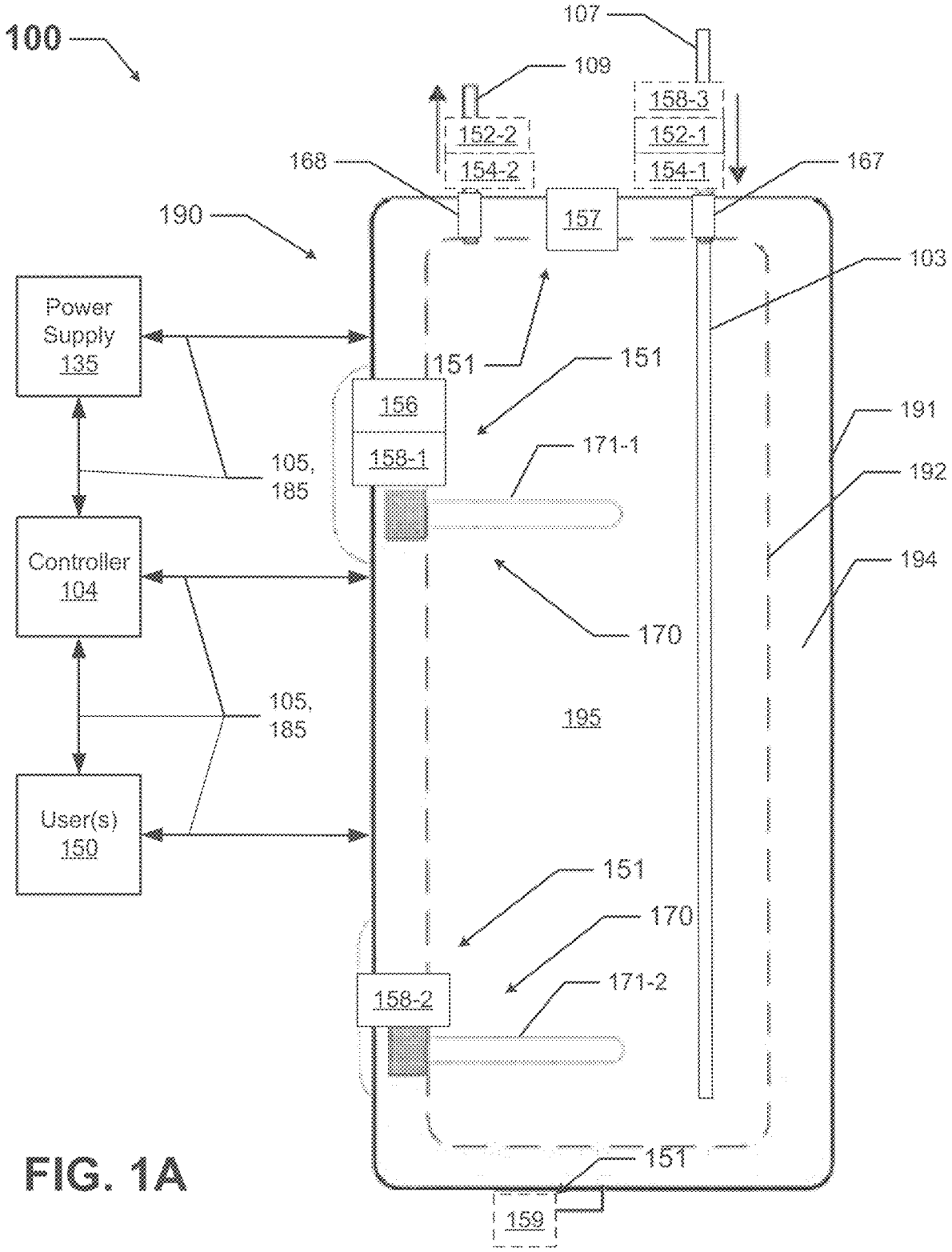
FIGS. 1A and 1B show diagrams of a system that includes a water heater and a controller in accordance with certain example embodiments.

In general, example embodiments provide systems, methods, and devices for determining the supply of hot water (also called heated water herein) in a storage-type water heater. Example embodiments can be used for any size (e.g., capacity) of water heater. Further, example embodiments can be located in any type of environment (e.g., warehouse, attic, garage, storage, mechanical room, basement) for any type (e.g., commercial, residential, industrial) of user. In addition, example embodiments can be used with any type of water heater, including but not limited to electric water heaters, gas water heaters, and heat pump water heaters. Water heaters used with example embodiments can be used for one or more of any number of processes (e.g., automatic clothes washers, automatic dishwashers, showers, sink faucets, heating systems, humidifiers).

Example embodiments can make a number of determinations with respect to hot water available from a hot water heater. For instance, example embodiments can determine how much hot water is currently in the tank of a hot water heater. As another example, embodiments can provide the temperature of the hot water that is currently available in the tank of the hot water heater. As yet another example, if the tank of a hot water heater is out of hot water, or if the tank of a water heater does not have enough hot water for a current use, example embodiments can estimate how long it will take for the water heater to generate a certain amount of hot water.

Water heater systems (or components thereof, including controllers) described herein can be made of one or more of a number of suitable materials to allow that device and/or other associated components of a system to meet certain standards and/or regulations while also maintaining durability in light of the one or more conditions under which the devices and/or other associated components of the system can be exposed. Examples of such materials can include, but are not limited to, aluminum, stainless steel, copper, fiberglass, glass, plastic, PVC, ceramic, and rubber.

Components of a water heater system (or portions thereof) described herein can be made from a single piece (as from a mold, injection mold, die cast, or extrusion process). In addition, or in the alternative, components of a water heater system (or portions thereof) can be made from multiple pieces that are mechanically coupled to each other. In such a case, the multiple pieces can be mechanically coupled to each other using one or more of a number of coupling methods, including but not limited to epoxy, welding, soldering, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Storage-type water heaters described herein have a rated capacity (also sometimes called a nameplate capacity) and an actual capacity. These capacities are with respect to the tank of the water heater, as described below. In many cases, the actual capacity is less than the rated capacity. For example, a storage-type electric water heater with a rated capacity of 50 gallons can have an actual capacity of 45 gallons. The difference between the actual and rated capacity of a water heater can vary based on one or more of a number of factors. For example, for an electric water heater, the actual capacity can be 90% of the nameplate capacity. Example embodiments described herein are directed to the actual capacity of the tank of the storage-type water heater, regardless of whether the water heater uses electricity, gas, or any other form of energy. The actual capacity is the amount of hot water that a tank can hold. The actual capacity can vary based on one or more of a number of factors, including but not limited to the configuration of heating elements, the energy source (e.g., electricity, natural gas) used for the heating system, and the construction of the tank.

In the foregoing figures showing example embodiments of water heaters with real-time hot water supply determination, one or more of the components shown may be omitted, repeated, and/or substituted. Accordingly, example embodiments of water heaters with real-time hot water supply determination should not be considered limited to the specific arrangements of components shown in any of the figures. For example, features shown in one or more figures or described with respect to one embodiment can be applied to another embodiment associated with a different figure or description.

In addition, if a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein. The numbering scheme for the various components in the figures herein is such that each component is a three digit number, and corresponding components in other figures have the identical last two digits.

In some cases, example embodiments can be subject to meeting certain standards and/or requirements. Examples of entities that set and/or maintain standards include, but are not limited to, the Department of Energy (DOE), the National Electric Code (NEC), the National Electrical Manufacturers Association (NEMA), the International Electrotechnical Commission (IEC), the American Society of Mechanical Engineers (ASME), the National Fire Protection Association (NEPA), the American Society of Heating, Refrigeration and Air Conditioning Engineers (ASHRAE), Underwriters' Laboratories (UL), and the Institute of Electrical and Electronics Engineers (IEEE). Use of example embodiments described herein meet (and/or allow a corresponding water heater system or portion thereof to meet) such standards when required.

Example embodiments of water heaters with real-time hot water supply determination will be described more fully hereinafter with reference to the accompanying drawings, in which example embodiments of water heaters with real-time hot water supply determination are shown. Water heaters with real-time hot water supply determination may, however, be embodied in many different forms and should not be construed as limited to the example embodiments set forth herein. Rather, these example embodiments are provided so that this disclosure will be thorough and complete, and will fully convey the scope of water heaters with real-time hot water supply determination to those of ordinary skill in the art. Like, but not necessarily the same, elements (also sometimes called components) in the various figures are denoted by like reference numerals for consistency.

Terms such as "first", "second", "third", "top", "bottom", "side", and "within" are used merely to distinguish one component (or part of a component or state of a component) from another. Such terms are not meant to denote a preference or a particular orientation. Such terms are not meant to limit embodiments of water heaters with real-time hot water supply determination. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
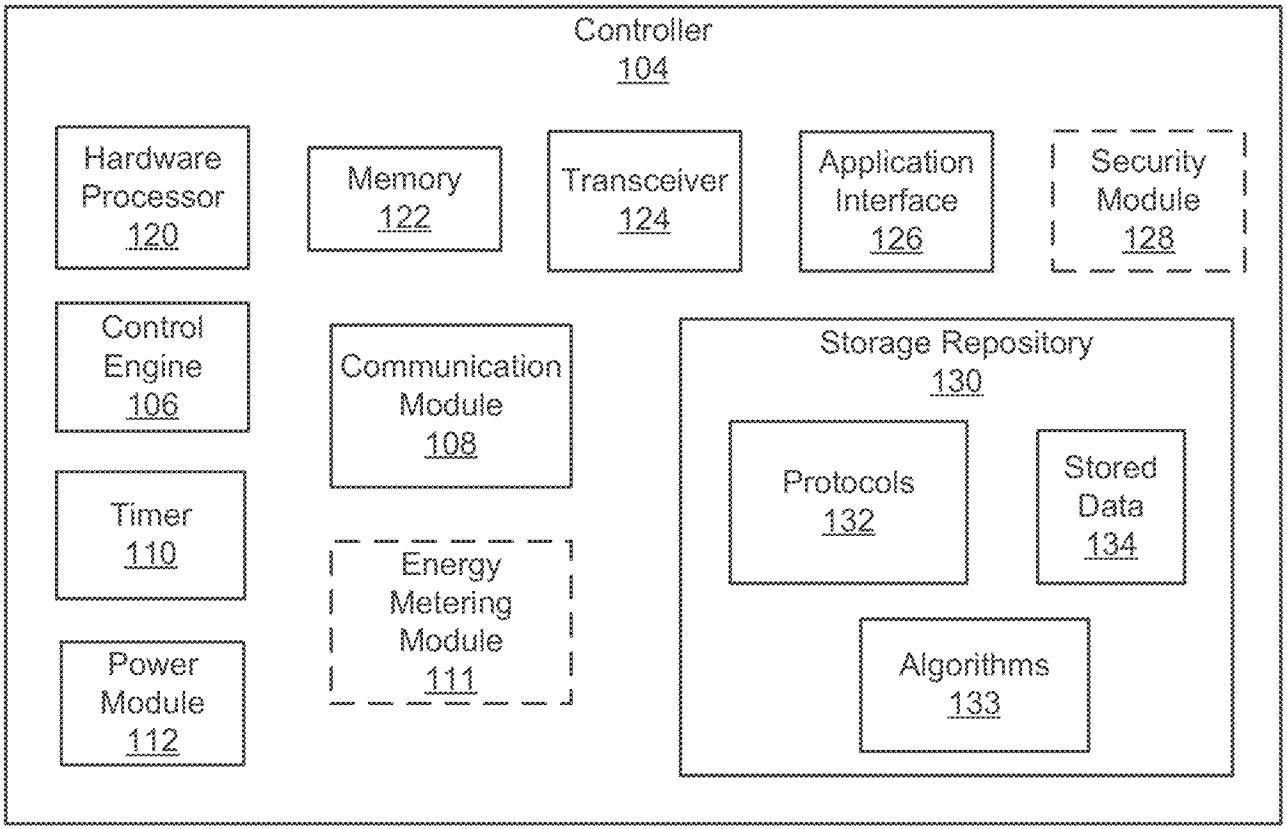

FIGS. 1A and 1B show diagrams of a water heating system 100 that includes a water heater 190 that is controlled (or at least monitored) by a controller 104 in accordance with certain example embodiments. Specifically, FIG. 1A shows the water heating system 100, and FIG. 1B shows a detailed system diagram of the controller 104. As shown in FIGS. 1A and 1B, the water heating system 100 can include the water heater 190, the controller 104, an inlet line 107, an outlet line 109, multiple sensors 151, a power supply 135, and a user 150. The water heater 190 is shown in a cross-sectional side view in FIG. 1A and can include one or more sensor devices 151 (also sometimes called sensor modules 151 or sensors 151), a dip tube 103, an inlet fitting 167, an outlet fitting 168, a tank 195, and a heating system 170.

As shown in FIG. 1B, the controller 104 can include one or more of a number of components. Such components, can include, but are not limited to, a control engine 106, a communication module 108, a timer 110, an optional energy metering module 111, a power module 112, a storage repository 130, a hardware processor 120, a memory 122, a transceiver 124, an application interface 126, and, optionally, a security module 128. The components shown in FIGS. 1A and 1B are not exhaustive, and in some embodiments, one or more of the components shown in FIGS. 1A and 1B may not be included in an example system. Further, one or more components shown in FIGS. 1A and 1B can be rearranged. For example, some or all of the inlet line 107 can be part of the water heater 190. Any component of the example water heating system 100 can be discrete or combined with one or more other components of the water heating system 100.

A user 150 may be any person or entity that interacts with the water heater 190 and/or the controller 104. Examples of a user 150 may include, but are not limited to, an engineer, an appliance or process that uses heated water, an electrician, an instrumentation and controls technician, a mechanic, an operator, a consultant, an electric utility, a grid operator, a retail electric provider, an energy marketing company, load forecasting software, a weather forecasting service, a network manager, a labor scheduling system, a contractor, a homeowner, a landlord, a building management company, and a manufacturer's representative. There can be one or multiple users 150 at any given time.

The user 150 can use and/or include a user system (not shown, but such as a smart phone or a laptop computer), which may include a display (e.g., a GUI). The user 150 can interact with (e.g., send data to, receive data from) the controller 104 via the application interface 126 (described below). The user 150 can also interact with the water heater 190 (including any components thereof, such as one or more of the sensor devices 151) and/or the power supply 135. Interaction between a user 150, the controller 104, the water heater 190, and the power supply 135 is conducted using signal transfer links 105 and/or power transfer links 185.

Each signal transfer link 105 and each power transfer link 185 can include wired (e.g., Class 1 electrical cables, Class 2 electrical cables, electrical connectors, electrical conductors, electrical traces on a circuit board, power line carrier, DALI, RS485) and/or wireless (e.g., Wi-Fi, visible light communication, Zigbee, mobile apps, text/email messages, cellular networking, Bluetooth, WirelessHART, ISA100) technology. For example, a signal transfer link 105 can be (or include) one or more electrical conductors that are coupled to the controller 104 and to a sensor device 151 of the water heater 190. A signal transfer link 105 can transmit signals (e.g., communication signals, control signals, data) between the controller 104, a user 150, the water heater 190 (including components thereof), and/or the power supply 135.

Similarly, a power transfer link 185 can transmit power between the controller 104, a user 150, the water heater 190 (including components thereof), and/or the power supply 135. One or more signal transfer links 105 and/or one or more power transfer links 185 can also transmit signals and power, respectively, between components (e.g., temperature sensor 158-2, optional flow sensor 154-1) within the water heater 190 and/or within the controller 104.

The power supply 135 provides power, directly or indirectly, to one or more components (e.g., the sensor devices 151, the controller 104, the heating system 170, a system of a user 150) of the water heating system 100. The power supply 135 can include one or more components (e.g., a transformer, a fuse) that receives power (for example, through an electrical cable) from an independent power source external to the heating system 100 and generates power of a type (e.g., AC, DC) and level (e.g., 240V, 120V) that can be used by one or more components of the heating system 100. For example, the power supply 135 can provide 240 VAC power to the heating system 170 of the water heater 190. In addition, or in the alternative, the power supply 135 can be or include a source of power in itself. For example, the power supply 135 can be or include a battery, a localized photovoltaic power system, or some other source of independent power. In certain example embodiments, the power supply 135 delivers 240 VAC.

As stated above, the water heater 190 in this example includes multiple sensor devices 151, a dip tube 103, an inlet fitting 167, an outlet fitting 168, a tank 195, and a heating system 170. The water heater 190 has an outer wall 191 and an inner wall 192, where the inner wall 192 forms the tank 195. Disposed between the outer wall 191 and the inner wall 192 can be disposed insulation 194 to help the tank 195 to retain heat longer. The inlet fitting 167 can be disposed within the insulation 194 and couple to the inlet line 107 at its top end and to the dip tube 103 at its bottom end. The outlet fitting 168 can also be disposed within the insulation 194 and couple to the outlet line 109 at its top end. In this example, both the inlet fitting 167 and the outlet fitting 168 are disposed at the top end of the water heater 190.

The inlet line 107 can be a pipe or other vessel that delivers unheated water to the tank 195 of the water heater 190. The distal end of the inlet line 107 is coupled, directly or indirectly, to the top end of the inlet fitting 167. The bottom end of the inlet fitting is coupled to the proximal end of the dip tube 103, which is disposed entirely within the water heater 190. The dip tube 103 can allow for the flow of unheated water into the tank 195 of the water heater 190. The dip tube 103 has a distal end that can be disposed at any point within the tank 195. Typically, as in this case, the distal end of the dip tube 103 is disposed near the bottom end of the tank 195. The top end of the outer wall 191 and the inner wall 192 of the water heater 190 have an aperture in which the inlet fitting 167 can be disposed therein. This configuration allows water (usually unheated water) to flow from an external source into the tank 195 of the water heater 190.

Similarly, the outlet line 109 can be a pipe or other vessel that can allow for the heated water in the tank 195 to flow out of the water heater 190. The outlet line 109 has a distal end that can be disposed at any point within the tank 195. Typically, as in this case, the distal end of the outlet line 109 is disposed near the top end of the tank 195. The top end of the outer wall 191 and the inner wall 192 of the water heater 190 have an aperture in which the outlet fitting 168 can be disposed. A segment of the outlet line 109 can be coupled to the bottom end of the outlet fitting 168, allowing that segment of the outlet line 109 to extend into the tank 195. The remainder of the outlet line 109 is coupled to the top end of the outlet fitting 168. This configuration allows heated water in the tank 195 to be drawn from the tank 195 of the water heater 190 so that the heated water can be delivered to one or more of a number of devices (e.g., clothes washer, dishwasher, faucets, shower heads) that use the heated water.

Each of the sensor devices 151 can measure one or more of a number of parameters. Examples of types of sensors 151 can include, but are not limited to, temperature sensor (e.g., a thermistor), a pressure sensor, a flow rate sensor, a scale, a voltmeter, an ammeter, a power meter, an ohmmeter, an electric power meter, and a resistance temperature detector. A sensor 151 can also include one or more components and/or devices (e.g., a potential transformer, a current transformer, electrical wiring) related to the measurement of a parameter.

A parameter that can be measured by a sensor 151 can include, but is not limited to, pressure, flow rate, current, voltage, power, resistance, weight, and temperature. In certain example embodiments, the parameter or parameters measured by a sensor 151 can be used by the controller 104 to determine an amount of heated water that is currently available within the tank 195 of the water heater 190 and/or how long it will take for an amount of heated water within the tank 195 of the water heater 190 to become available. Each sensor 151 can use one or more of a number of communication protocols. A sensor 151 can be a stand-alone device or integrated with another component (e.g., the heating system 170) in the system 100. A sensor 151 can measure a parameter continuously, periodically, based on the occurrence of an event, based on a command received from the control module 106 of the controller 104, and/or based on some other factor.

In this example, there are three temperature sensors (temperature sensor 158-1, temperature sensor 158-2, and optional temperature sensor 158-3), at least one optional flow sensor (for example, flow sensor 154-1 and/or 154-2), and an optional water leak sensor 159, all of which are types of sensors 151. The optional water leak sensor 159 is disposed toward the bottom end of the water heater 190 and detects a leak in the tank 195 of the water heater 190. The optional flow sensor measures the rate of flow of unheated water in the inlet line 107 when entering the tank 195. Temperature sensor 158-1 is located toward the top end (e.g., approximately ¼ the height of the tank 195 from the top end of the tank 195) and measures the temperature of the water (e.g., heated water, unheated water, mixture of heated water and unheated water) in the tank 195 at that point. This temperature measured by temperature sensor 158-1 can be an indication of the maximum temperature of the heated water in the tank 195, although, since heat rises, the temperature of the heated water in the tank 195 above the temperature sensor 158-1 is same or higher than the temperature measured by the temperature sensor 158-1.

Temperature sensor 158-2 is located toward the bottom end (e.g., approximately ¼ the height of the tank 195 from the bottom end of the tank 195) and measures the temperature of the water (e.g., heated water, unheated water, mixture of heated water and unheated water) in the tank 195 at that point. Since heat rises, the temperature measured by temperature sensor 158-2 should be no greater than the temperature measured by the temperature sensor 158-1. If this event occurs, the controller 104 can determine that temperature sensor 158-1 and/or temperature sensor 158-2 are faulty and require maintenance and/or replacement. Optional temperature sensor 158-3 measures the temperature of the unheated water in the inlet line 107 before the unheated water flows into the tank 195. The controller 104 uses the measurements made by some or all of these sensors 151 to determine such things as the amount of heated water available in the tank 195 for immediate use and how long it will take for a certain amount of heated water to become available in the tank 195.

The water heater 190 can also include one or more valves (for example, valve 152-1 and/or valve 152-2). In this example, the water heater 190 includes a valve 152-1 that controls the rate of flow (or the flow itself) of the unheated water in the inlet tube 107, as well as an optional valve 152-2 that controls the rate of flow (or the flow itself) of heater water in the outlet tube 109. In certain example embodiments, the position (e.g., fully open, fully closed, 30% open) of a valve can be controlled by the controller 104. The water heater 190 can further include a switch 156 (also called an emergency cutout switch 156 or an ECO 156) that controls the energy (e.g., electrical power, gas) delivered to the heating system 170. The switch 156 can have an open position (preventing energy from flowing to the heating system 170) and a closed position (allowing energy to flow to the heating system 170). The position and operation of the switch 156 can be independent of the controller 104.

The water heater 190 can also include a temperature and pressure relief valve 157 that is disposed in the top of the tank 195, the top of the outer wall 191, and the insulation disposed therebetween. The relief valve 157 can be a purely mechanical device (e.g., not controlled by the controller 104) that detects when the pressure and/or temperature within the tank 195 exceeds a threshold value for that parameter. If such an event were to occur, the relief valve 157 would operate from a normally-closed position to an open position.

If the relief valve 157 determines that the pressure within the tank 195 exceeds a maximum threshold value, then the relief valve 157 opens to allow the excess pressure to vent out the top of the water heater 190 into the ambient environment. When the pressure within the tank 195 measured by the relief valve 157 falls back within a safe range (another threshold value), then the relief valve 157 returns to the closed position. Similarly, if the relief valve 157 determines that the temperature within the tank 195 exceeds a maximum threshold value, then the relief valve 157 opens to allow the excess temperature to vent out the top of the water heater 190 into the ambient environment. When the temperature within the tank 195 measured by the relief valve 157 falls back within a safe range (another threshold value), then the relief valve 157 returns to the closed position.

The heating system 170 of the water heater 190 can include one or more devices (or components thereof) that consume energy (e.g., electricity, natural gas, propane) during operation. An example of such a device or component of the heating system 170 can include the heating elements (for example, heating element 171-1 and/or heating element 171-2) shown in FIG. 1A. In this case, there are two heating elements that extend toward the center of the tank 195. Heating element 171-1 is located toward the top of the tank 195 (e.g., approximately ⅓ the height of the tank 195 from the top end of the tank 195). Heating element 171-2 is located toward the bottom of the tank 195 (e.g., approximately ⅙ the height of the tank 195 from the bottom end of the tank 195).

Those of ordinary skill in the art will appreciate that heating systems 170 for water heaters 190 can have any of a number of other configurations. In any case, the controller 104 is aware of the devices, components, ratings, positioning, and any other relevant information regarding the heating system 170 relative to the tank 195. In some cases, one or more devices of the heating system 170 can have its own local controller. In such a case, the controller 104 can communicate with the local controller of the heating system 170 using signal transfer links 105 and/or power transfer links 185.

A user 150, the power supply 135, and/or the water heater 190 (including the sensors 151 and a local controller, if any) can interact with the controller 104 using the application interface 126 in accordance with one or more example embodiments. Specifically, the application interface 126 of the controller 104 receives data (e.g., information, communications, instructions, updates to firmware) from and sends data (e.g., information, communications, instructions) to a user 150, the power supply 135, and/or the water heater 190. The user 150, the power supply 135, and the water heater 190 (including portions thereof) can include an interface to receive data from and send data to the controller 104 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof. For example, referring to FIG. 2 below, the controller 104 can include a user interface having one or more of a number of I/O devices 216 (e.g., buzzer, alarm, indicating light, pushbutton).

The controller 104, a user 150, the power supply 135, and/or the water heater 190 can use their own system or share a system in certain example embodiments. Such a system can be, or contain a form of, an Internet-based or an intranet-based computer system that is capable of communicating with various software. A computer system includes any type of computing device and/or communication device, including but not limited to the controller 104. Examples of such a system can include, but are not limited to, a desktop computer with Local Area Network (LAN), Wide Area Network (WAN), Internet or intranet access, a laptop computer with LAN, WAN, Internet or intranet access, a smart phone, a server, a server farm, an android device (or equivalent), a tablet, smartphones, and a personal digital assistant (PDA). Such a system can correspond to a computer system as described below with regard to FIG. 2.

Further, as discussed above, such a system can have corresponding software (e.g., user software, sensor device software). The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, LAN, WAN, or other network communication methods) and/or communication channels, with wire and/or wireless segments according to some example embodiments. The software of one system can be a part of, or operate separately but in conjunction with, the software of another system within the water heating system 100.

The controller 104 can be a stand-alone device or integrated with another component (e.g., the water heater 190) in the water heating system 100. When the controller 104 is a stand-alone device, the controller 104 can include a housing. In such a case, the housing can include at least one wall that forms a cavity. In some cases, the housing can be designed to comply with any applicable standards so that the controller 104 can be located in a particular environment (e.g., a hazardous environment, a high temperature environment, a high humidity environment).

The housing of the controller 104 can be used to house one or more components of the controller 104. For example, the controller 104 (which in this case includes the control engine 106, the communication module 108, the timer 110, the optional energy metering module 111, the power module 112, the storage repository 130, the hardware processor 120, the memory 122, the transceiver 124, the application interface 126, and the optional security module 128) can be disposed in a cavity formed by a housing. In alternative embodiments, any one or more of these or other components of the controller 104 can be disposed on a housing and/or remotely from a housing.

The storage repository 130 can be a persistent storage device (or set of devices) that stores software and data used to assist the controller 104 in communicating with a user 150, the power supply 135, and water heater 190 (including components thereof) within the heating system 100. In one or more example embodiments, the storage repository 130 stores one or more protocols 132, one or more algorithms 133, and stored data 134. The protocols 132 can be any procedures (e.g., a series of method steps) and/or other similar operational procedures that the control engine 106 of the controller 104 follows based on certain conditions at a point in time. The protocols 132 can include any of a number of communication protocols 132 that are used to send and/or receive data between the controller 104 and a user 150, the power supply 135, and the water heater 190.

A protocol 132 can be used for wired and/or wireless communication. Examples of a protocol 132 can include, but are not limited to, Econet, Modbus, profibus, Ethernet, and fiberoptic. One or more of the communication protocols 132 can be a time-synchronized protocol. Examples of such time-synchronized protocols can include, but are not limited to, a highway addressable remote transducer (HART) protocol, a wireless HART protocol, and an International Society of Automation (ISA) 100 protocol. In this way, one or more of the communication protocols 132 can provide a layer of security to the data transferred within the system 100.

The algorithms 133 can be any formulas, mathematical models, and/or other suitable means of manipulating and/or processing data. One or more algorithms 133 can be used for a particular protocol 132. As discussed above, the controller 104 uses information (e.g., temperature measurements) provided by the sensor devices 151 to generate, using one or more protocols 132 and/or one or more algorithms 133, information related to the availability of heated water in the tank 195 of the water heater 190 to a user 150.

For example, a protocol 132 and/or an algorithm 133 can dictate when a measurement is taken by a sensor device 151 and which particular sensor devices 151 take a measurement at that point in time. As another example, a protocol 132 and/or an algorithm 133 can be used, in conjunction with measurements made by one or more sensor devices 151, by the controller 104 to determine how much heated water is in the tank 195 of the water heater 190 and available for immediate use by a user 150.

As yet another example, a protocol 132 and/or an algorithm 133 can be used by the controller 104 to determine whether the amount of heated water currently in the tank 195 is insufficient for a desired use of a user 150. In such a case, the controller 104 can use a protocol 132 and/or an algorithm 133 to determine how long it will take for the proper amount of water in the tank 195 to be heated and ready for a particular use. As still another example, a protocol 132 and/or an algorithm 133 can be used by the controller 104 to alter, suspend, and/or resume operation of the heating system 170.

Stored data 134 can be any data associated with the water heating system 100 (including any components thereof), any measurements taken by the sensor devices 151, time measured by the timer 110, adjustments to an algorithm 133, threshold values, set point values, user preferences, default values, results of previously run or calculated algorithms 133, and/or any other suitable data. Such data can be any type of data, including but not limited to historical data for the water heating system 100 (including any components thereof, such as the sensor devices 151 and the heating system 170), present data (e.g., calculations, adjustments made to calculations based on actual data, measurements taken by one or more sensor devices 151), and forecasts. The stored data 134 can be associated with some measurement of time derived, for example, from the timer 110.

Examples of a storage repository 130 can include, but are not limited to, a database (or a number of databases), a file system, a hard drive, flash memory, some other form of solid state data storage, or any suitable combination thereof. The storage repository 130 can be located on multiple physical machines, each storing all or a portion of the protocols 132, the algorithms 133, and/or the stored data 134 according to some example embodiments. Each storage unit or device can be physically located in the same or in a different geographic location. Some or all of the storage repository 130 can use a cloud-based platform and/or technology.

The storage repository 130 can be operatively connected to the control engine 106. In one or more example embodiments, the control engine 106 includes functionality to communicate with the user 150, the power supply 135, and the water heater 190 (including components thereof) in the water heating system 100. More specifically, the control engine 106 sends information to and/or receives information from the storage repository 130 in order to communicate with the user 150, the power supply 135, and the water heater 190. As discussed below, the storage repository 130 can also be operatively connected to the communication module 108 in certain example embodiments.

In certain example embodiments, the control engine 106 of the controller 104 controls the operation of one or more components (e.g., the communication module 108, the timer 110, the transceiver 124) of the controller 104. For example, the control engine 106 can activate the communication module 108 when the communication module 108 is in "sleep" mode and when the communication module 108 is needed to send data received from another component (e.g., switch 156, a sensor 151, the user 150) in the water heating system 100.

As another example, the control engine 106 can acquire the current time using the timer 110. The timer 110 can enable the controller 104 to control the heating system 170 (including any components thereof). As yet another example, the control engine 106 can direct a sensor 151 to measure a parameter (e.g., temperature) and send the measurement by reply to the control engine 106.

Figure 3:
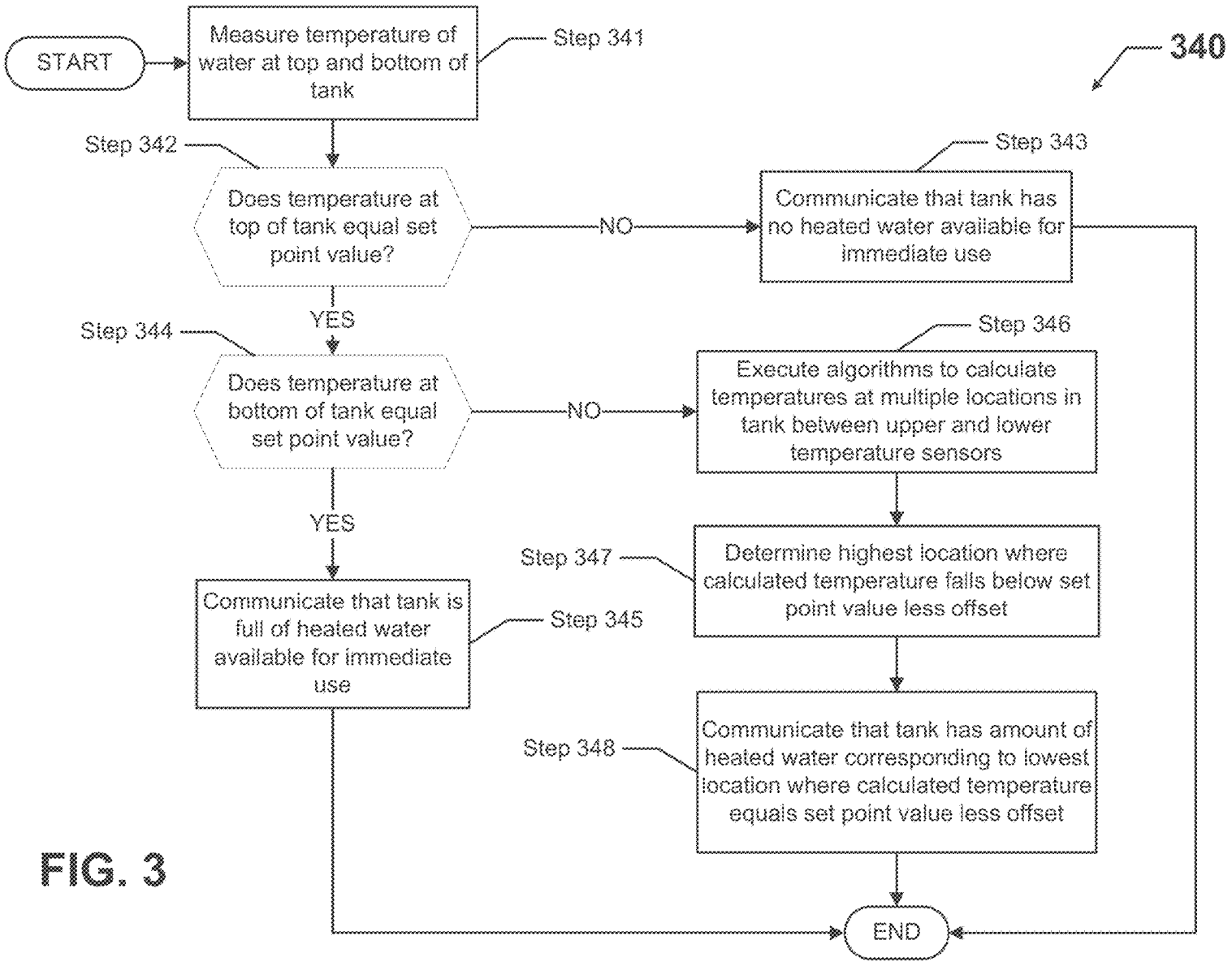
FIGS. 3 and 4 each show a flowchart for determining hot water supply in water heaters in accordance with certain example embodiments.
Figure 4:
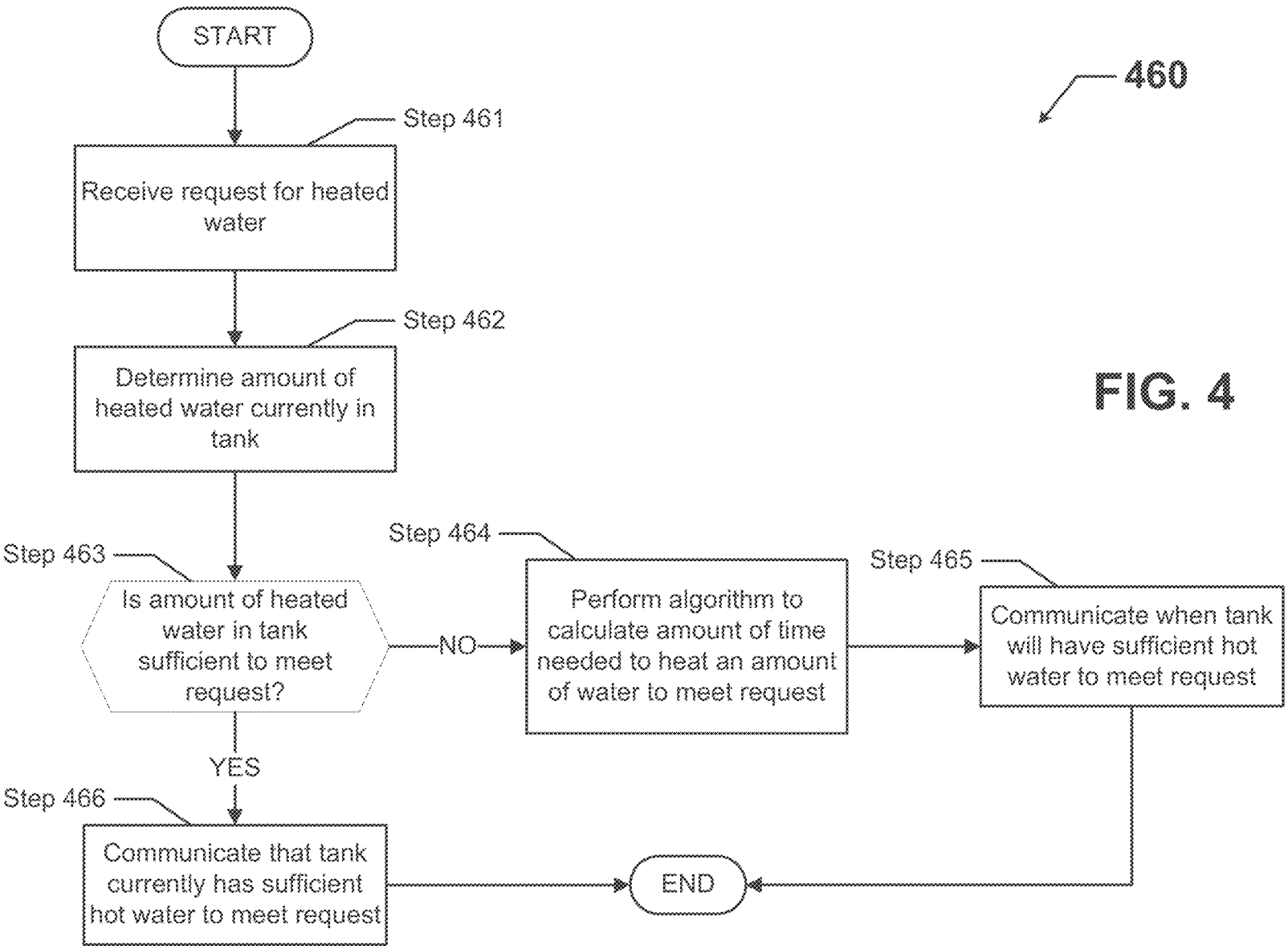

The control engine 106 can be configured to perform a number of functions that help the controller 104 make a determination (an estimate) that relates to the amount of heated water in the tank 195 of the water heater 190 at a particular point in time. For example, the control engine 106 can execute any of the protocols 132 and/or algorithms 133 stored in the storage repository 130 and use the results of those protocols 132 and/or algorithms 133 to communicate to a user 150 an amount of heated water currently available in the tank 195 of the water heater 190. As another example, if there is an insufficient amount of heated water currently available in the tank 195 of the water heater 190, the control engine 106 can execute other protocols 132 and/or algorithms 133 and use the results of those protocols 132 and/or algorithms 133 to communicate to a user 150 how long it will take to achieve some amount of heated water within the tank 195 of the water heater 190. FIGS. 3 and 4 below provide more specific examples of how the control engine 106 functions according to certain example embodiments.

The control engine 106 can generate an alarm or some other form of communication when an operating parameter (e.g., amount of heated water in tank 195 of water heater 190, temperature read by a temperature sensor) exceeds or falls below a threshold value (e.g., a set point value) (in other words, falls outside an acceptable range of values). The control engine 106 can also track measurements made by a sensor device 151 (e.g., temperature sensor 158-1) and determine a possible present or future failure of the sensor device 151 or some other component of the water heater 190 or a portion thereof (e.g., the water heating system 100).

Using one or more algorithms 133, the control engine 106 can predict the expected useful life of these components based on stored data 134, a protocol 132, one or more threshold values, and/or some other factor. The control engine 106 can also measure (using one or more sensors 151) and analyze the efficiency of the water heater 190 over time. An alarm can be generated by the control engine 106 when the efficiency of a component of the water heating system 100 falls below a threshold value, indicating failure of that component.

If the control engine 106 determines there is an insufficient amount of heated water within the tank 195 of the water heater 190, the control engine 106 can control one or more components (e.g., the heating system 170, a valve 152-1 and/or 152-2) to get the amount of heated water within the tank 195 of the water heater 190 to within an acceptable range of values (e.g., default values, user-selected values such as set point values).

The control engine 106 can perform its evaluation functions and resulting actions on a continuous basis, periodically, during certain time intervals, or randomly. Further, the control engine 106 can perform this evaluation for the present time or for a period of time in the future. For example, the control engine 106 can perform forecasts to determine the volume of heated water that will be in the tank 195 of the water heater 190 after a specified period of time. The control engine 106 can adjust a forecast (e.g., every hour, when new information from a user 150 or a sensor device 151 is received).

The control engine 106 can provide power, control, communication, and/or other similar signals to a user 150, the power supply 135, and the water heater 190 (including components thereof). Similarly, the control engine 106 can receive power, control, communication, and/or other similar signals from a user 150, the power supply 135, and the water heater 190. The control engine 106 can control each sensor 151, valve 152-1 and/or 152-2, and/or other component in the water heating system 100 automatically (for example, based on one or more algorithms 133 and/or protocols 132 stored in the storage repository 130) and/or based on power, control, communication, and/or other similar signals received from another device through a signal transfer link 105 and/or a power transfer link 185. The control engine 106 may include a printed circuit board, upon which the hardware processor 120 and/or one or more discrete components of the controller 104 are positioned.

In certain embodiments, the control engine 106 of the controller 104 can communicate with one or more components (e.g., a network manager) of a system external to the water heating system 100. For example, the control engine 106 can interact with an inventory management system by ordering a component (e.g., a sensor device 151) to replace a sensor device 151 (e.g., optional temperature sensor 158-3) that the control engme 106 has determined has failed or is failing. As another example, the control engine 106 can interact with a workforce scheduling system by scheduling a maintenance crew to repair or replace a component of the water heating system 100 when the control engine 106 determines that the component requires maintenance or replacement.

In certain example embodiments, the control engme 106 can include an interface that enables the control engine 106 to communicate with one or more components (e.g., a user 150, a switch 156) of the water heating system 100. For example, if a user 150 operates under IEC Standard 62386, then the user 150 can have a serial communication interface that will transfer data (e.g., stored data 134) measured by the sensors 151. In such a case, the control engine 106 can also include a serial interface to enable communication with the user 150. Such an interface can operate in conjunction with, or independently of, the protocols 132 used to communicate between the controller 104 and a user 150, the power supply 135, and the water heater 190 (or components thereof).

The control engine 106 (or other components of the controller 104) can also include one or more hardware components (e.g., peripherals) and/or software elements to perform its functions. Such components can include, but are not limited to, a universal asynchronous receiver/transmitter (UART), a serial peripheral interface (SPI), an analog-to-digital converter, an inter-integrated circuit ($I^2C$), and a pulse width modulator (PWM).

The communication module 108 of the controller 104 determines and implements the communication protocol (e.g., from the protocols 132 of the storage repository 130) that is used when the control engine 106 communicates with (e.g., sends signals to, receives signals from) a user 150, the power supply 135, and the water heater 190 (or components thereof). In some cases, the communication module 108 accesses the stored data 134 to determine which communication protocol is used to communicate with a sensor 151 associated with certain stored data 134. In addition, the communication module 108 can interpret the communication protocol of a communication received by the controller 104 so that the control engine 106 can interpret the communication.

The communication module 108 can send and receive data between the power supply 135, the water heater 190 (or components thereof), and/or the users 150 and the controller 104. The communication module 108 can send and/or receive data in a given format that follows a particular protocol 132. The control engme 106 can interpret the data packet received from the communication module 108 using the protocol 132 information stored in the storage repository 130. The control engine 106 can also facilitate the data transfer between the water heater (or components thereof), the power supply 135, and a user 150 by converting the data into a format understood by the communication module 108.

The communication module 108 can send data (e.g., protocols 132, algorithms 133, stored data 134, operational information, alarms) directly to and/or retrieve data directly from the storage repository 130. Alternatively, the control engine 106 can facilitate the transfer of data between the communication module 108 and the storage repository 130. The communication module 108 can also provide encryption to data that is sent by the controller 104 and decryption to data that is received by the controller 104. The communication module 108 can also provide one or more of a number of other services with respect to data sent from and received by the controller 104. Such services can include, but are not limited to, data packet routing information and procedures to follow in the event of data interruption.

The timer 110 of the controller 104 can track clock time, intervals of time, an amount of time, and/or any other measure of time. The timer 110 can also count the number of occurrences of an event, whether with or without respect to time. Alternatively, the control engine 106 can perform the counting function. The timer 110 is able to track multiple time measurements concurrently. The timer 110 can track time periods based on an instruction received from the control engine 106, based on an instruction received from the user 150, based on an instruction programmed in the software for the controller 104, based on some other condition or from some other component, or from any combination thereof.

The timer 110 can be configured to track time when there is no power delivered to the controller 104 (e.g., the power module 112 malfunctions) using, for example, a super capacitor or a battery backup. In such a case, when there is a resumption of power delivery to the controller 104, the timer 110 can communicate any aspect of time to the controller 104. In such a case, the timer 110 can include one or more of a number of components (e.g., a super capacitor, an integrated circuit) to perform these functions.

The power module 112 of the controller 104 provides power to one or more other components (e.g., timer 110, control engine 106) of the controller 104. In addition, in certain example embodiments, the power module 112 can provide power to one or more components (e.g., the heating system 170 of the water heater 190, the switch 156, a valve 152-1 and/or 152-2) of the water heating system 100. The power module 112 can include one or more of a number of single or multiple discrete components (e.g., transistor, diode, resistor), and/or a microprocessor. The power module 112 may include a printed circuit board, upon which the microprocessor and/or one or more discrete components are positioned. In some cases, the power module 112 can include one or more components that allow the power module 112 to measure one or more elements of power (e.g., voltage, current) that is delivered to and/or sent from the power module 112. Alternatively, the controller 104 can include a power metering module (not shown) to measure one or more elements of power that flows into, out of, and/or within the controller 104.

The power module 112 can include one or more components (e.g., a transformer, a diode bridge, an inverter, a converter) that receives power (for example, through an electrical cable) from the power supply 135 and generates power of a type (e.g., AC, DC) and level (e.g., 12V, 24V, 120V) that can be used by the other components of the controller 104 and/or by the water heater 190. For example, 240 VAC received from the power supply 135 by the power module 112 can be converted to 12 VDC by the power module 112. The power module 112 can use a closed control loop to maintain a preconfigured voltage or current with a tight tolerance at the output. The power module 112 can also protect the remainder of the electronics (e.g., hardware processor 120, transceiver 124) in the controller 104 from surges generated in the line.

In addition, or in the alternative, the power module 112 can be a source of power in itself to provide signals to the other components of the controller 104. For example, the power module 112 can be or include a battery. As another example, the power module 112 can be or include a localized photovoltaic power system. In certain example embodiments, the power module 112 of the controller 104 can also provide power and/or control signals, directly or indirectly, to one or more of the sensor devices 151. In such a case, the control engine 106 can direct the power generated by the power module 112 to one or more of the sensor devices 151. In this way, power can be conserved by sending power to the sensor devices 151 when those devices need power, as determined by the control engine 106.

The optional energy metering module 111 of the controller 104 can measure one or more components of power (e.g., current, voltage, resistance, VARs, watts) at one or more points (e.g., output of the power supply 135) associated with the water heating system 100. The energy metering module 111 can include any of a number of measuring devices and related devices, including but not limited to a voltmeter, an ammeter, a power meter, an ohmmeter, a current transformer, a potential transformer, and electrical wiring. The energy metering module 111 can measure a component of power continuously, periodically, based on the occurrence of an event, based on a command received from the control module 106, and/or based on some other factor. If there is no energy metering module 111, then the controller 104 can estimate one or more components of power using one or more algorithms 133.

The hardware processor 120 of the controller 104 executes software, algorithms 133, and firmware in accordance with one or more example embodiments. Specifically, the hardware processor 120 can execute software on the control engine 106 or any other portion of the controller 104, as well as software used by a user 150, the power supply 135, and the water heater 190 (or portions thereof). The hardware processor 120 can be an integrated circuit, a central processing unit, a multi-core processing chip, SoC, a multi-chip module including multiple multi-core processing chips, or other hardware processor in one or more example embodiments. The hardware processor 120 is known by other names, including but not limited to a computer processor, a microprocessor, and a multi-core processor.

In one or more example embodiments, the hardware processor 120 executes software instructions stored in memory 122. The memory 122 includes one or more cache memories, main memory, and/or any other suitable type of memory. The memory 122 can include volatile and/or non-volatile memory. The memory 122 is discretely located within the controller 104 relative to the hardware processor 120 according to some example embodiments. In certain configurations, the memory 122 can be integrated with the hardware processor 120.

In certain example embodiments, the controller 104 does not include a hardware processor 120. In such a case, the controller 104 can include, as an example, one or more field programmable gate arrays (FPGA), one or more insulated-gate bipolar transistors (IGBTs), and one or more integrated circuits (ICs). Using FPGAs, IGBTs, ICs, and/or other similar devices known in the art allows the controller 104 (or portions thereof) to be programmable and function according to certain logic rules and thresholds without the use of a hardware processor. Alternatively, FPGAs, IGBTs, ICs, and/or similar devices can be used in conjunction with one or more hardware processors 120.

The transceiver 124 of the controller 104 can send and/or receive control and/or communication signals. Specifically, the transceiver 124 can be used to transfer data between the controller 104 and the user 150, the power supply 135, and the water heater 190 (or portions thereof). The transceiver 124 can include a transmitter, a receiver, or a combination of the two. The transceiver 124 can use wired and/or wireless technology. The transceiver 124 can be configured in such a way that the control and/or communication signals sent and/or received by the transceiver 124 can be received and/or sent by another transceiver that is part of the user 150, the power supply 135, and the water heater 190 (or portions thereof). The transceiver 124 can use any of a number of signal types, including but not limited to radio frequency signals.

When the transceiver 124 uses wireless technology, any type of wireless technology can be used by the transceiver 124 in sending and receiving signals. Such wireless technology can include, but is not limited to, Wi-Fi, visible light communication, Zigbee, mobile apps, text/email messages, cellular networking, and Bluetooth. The transceiver 124 can use one or more of any number of suitable communication protocols (e.g., ISA100, HART) when sending and/or receiving signals. Such communication protocols can be stored in the protocols 132 of the storage repository 130. Further, any transceiver information for a user 150, the power supply 135, and the water heater 190 (or portions thereof) can be part of the stored data 134 (or similar areas) of the storage repository 130.

Optionally, in one or more example embodiments, the security module 128 secures interactions between the controller 104, the user 150, the power supply 135, and the water heater 190 (or portions thereof). More specifically, the security module 128 authenticates communication from software based on security keys verifying the identity of the source of the communication. For example, user software may be associated with a security key enabling the software of a user 150 to interact with the controller 104 and/or the sensors 151. Further, the security module 128 can restrict receipt of information, requests for information, and/or access to information in some example embodiments.

Figure 2:
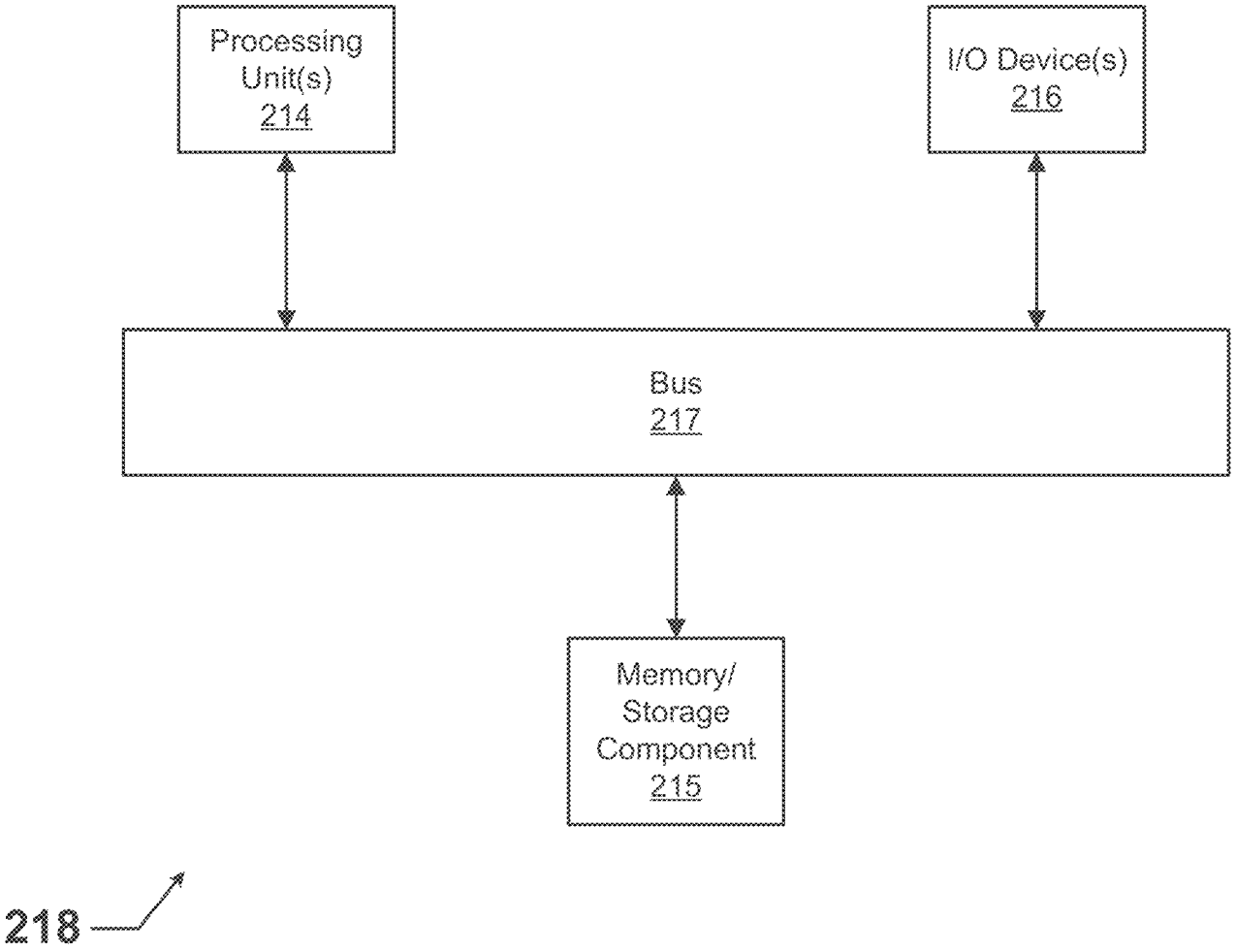
FIG. 2 shows a computing device in accordance with certain example embodiments.

FIG. 2 illustrates one embodiment of a computing device 218 that implements one or more of the various techniques described herein, and which is representative, in whole or in part, of the elements described herein pursuant to certain example embodiments. For example, the controller 104 of FIGS. 1A and 1B can be a computing device 218, and its various components (e.g., transceiver 124, storage repository 130, control engine 106) can be components of a computing device 218, as discussed below.

Computing device 218 is one example of a computing device and is not intended to suggest any limitation as to scope of use or functionality of the computing device and/or its possible architectures. Neither should computing device 218 be interpreted as having any dependency or requirement relating to any one or combination of components illustrated in the example computing device 218.

Computing device 218 includes one or more processors or processing units 214, one or more memory/storage components 215, one or more input/output (I/O) devices 216, and a bus 217 that allows the various components and devices to communicate with one another. Bus 217 represents one or more of any of several types of bus structures, including a memory bus or memory controller, a peripheral bus, an accelerated graphics port, and a processor or local bus using any of a variety of bus architectures. Bus 217 includes wired and/or wireless buses.

Memory/storage component 215 represents one or more computer storage media. Memory/storage component 215 includes volatile media (such as random access memory (RAM)) and/or nonvolatile media (such as read only memory (ROM), flash memory, optical disks, magnetic disks, and so forth). Memory/storage component 215 includes fixed media (e.g., RAM, ROM, a fixed hard drive, etc.) as well as removable media (e.g., a flash memory drive, a removable hard drive, an optical disk, and so forth).

One or more I/O devices 216 allow a customer, utility, or other user to enter commands and information to computing device 218, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 218 is connected to a network (not shown) (e.g., a LAN, a WAN such as the Internet, cloud, or any other similar type of network) via a network interface connection (not shown) according to some example embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other example embodiments. Generally speaking, the computer system 218 includes at least the minimal processing, input, and/or output means necessary to practice one or more embodiments.

Further, those skilled in the art will appreciate that one or more elements of the aforementioned computer device 218 can be located at a remote location and connected to the other elements over a network in certain example embodiments. Further, one or more embodiments is implemented on a distributed system having one or more nodes, where each portion of the implementation (e.g., control engine 106) is located on a different node within the distributed system. In one or more embodiments, the node corresponds to a computer system. Alternatively, the node corresponds to a processor with associated physical memory in some example embodiments. The node alternatively corresponds to a processor with shared memory and/or resources in some example embodiments.

FIGS. 3 and 4 each show a flowchart for determining hot water supply in a water heater in accordance with certain example embodiments. While the various steps in these flowcharts are presented and described sequentially, one of ordinary skill in the art will appreciate that some or all of the steps can be executed in different orders, combined or omitted, and some or all of the steps can be executed in parallel depending upon the example embodiment. Further, in one or more of the example embodiments, one or more of the steps described below can be omitted, repeated, and/or performed in a different order. For example, the process of managing the amount of heated water within the tank 195 can be a continuous process, and so the START and END steps shown in FIGS. 3 and 4 can merely denote the start and end of a particular series of steps within a continuous process.

In addition, a person of ordinary skill in the art will appreciate that additional steps not shown in FIGS. 3 and 4 can be included in performing these methods in certain example embodiments. Accordingly, the specific arrangement of steps should not be construed as limiting the scope. In addition, a particular computing device, as described, for example, in FIG. 2 above, is used to perform one or more of the steps for the methods described below in certain example embodiments. For the methods described below, unless specifically stated otherwise, a description of the controller 104 performing certain functions can be applied to the control engine 106 of the controller 104.

For clarity, the controller 104 described herein can control other aspects of the system 100 while performing the functions described above and in the methods of FIGS. 3 and 4 below. For example, the controller 104 can control the heating system 170 independently of, or in conjunction with, the functions described herein. In such a case, the heating system 170 can be controlled in one or more of a number of ways. For example, the controller 104 can suspend operation of the heating system 170 until the temperature of the heated water drops below some minimum threshold value (e.g., a set point value, which is part of the stored data 134), at which point the controller 104 can resume operation of the heating system 170. This cycle can continue until heated water is drawn from the tank 195. As another example, the controller 104 can reduce the level of heat generated by the heating system 170 until heated water is drawn from the tank 195.

Referring to FIGS. 1A through 4, the example method 340 of FIG. 3 begins at the START step and proceeds to step 341, where the temperatures of the water at the top and bottom of the tank 195 are measured. The temperatures can be measured by one or more sensor devices 151 (e.g., temperature sensor 158-1, temperature sensor 158-2) that measure the temperature of the water within the tank 195. When multiple temperature sensors are used, they can be placed at different locations within the tank 195. For example, one temperature sensor (e.g., temperature sensor 158-1) can measure a temperature of the water toward the top end of the tank 195, and another temperature sensor (e.g., temperature sensor 158-2) can measure a temperature of the water toward the bottom end of the tank 195. A temperature measured by a temperature sensor can be an absolute temperature or a differential temperature (e.g., the difference between the temperature measured by temperature sensor 158-1 and the temperature measured by temperature sensor 158-2). The temperature sensors can measure temperature based on instructions received by the controller 104. Once the temperatures are measured, the temperature sensors can send the measurements to the controller 104.

Once the controller 104 receives the temperature measurements from step 341, the controller 104 evaluates those temperature measurements. For example, in step 342 a determination is made as to whether the temperature measurement toward the top end of the tank 195 exceeds or equals a set point value (a type of threshold value). The determination can be made by the controller 104 using one or more protocols 132 and/or algorithms 133 stored in the storage repository 130. The set point value can be part of the stored data 134 of the storage repository 130. The set point value can be some desired temperature at which the water toward the top end of the tank 195 can be considered heated water. The set point value can be an actual temperature value. Alternatively, the set point value can be a differential of set point values. If the temperature measurement toward the top end of the tank 195 exceeds the set point value, then the process proceeds to step 344. If the temperature measurement toward the top end of the tank 195 does not exceed the threshold value, then there is no heated water in the tank 195 and the process proceeds to step 343.

In step 343, the controller 104 communicates to a user 150 that there is no heated water available in the tank 195 at that point in time. In some cases, an algorithm 133 is performed by the controller 104 to determine the amount of time needed to heat the water toward the top end of the tank 195 to the set point temperature value. Alternatively, an algorithm 133 can be performed by the controller 104 to determine the amount of time needed to heat the water in the entire tank 195 to the set point temperature value. The results of this algorithm 133 can also allow the controller 104 to communicate to a user 150 the amount of heated water available for immediate use.

The controller 104 can communicate in one or more of any number of ways. For example, the controller 104 can emit, through a speaker, an audible notification. As another example, the controller 104 can send a SMS message to the mobile device of one or more users 150. As yet another example, the controller 104 can post a message on a display. As still another example, the controller 104 can send an email to one or more users 150. The controller 104 can use the transceiver 124 when communicating.

The algorithms 133 can be stored in the storage repository 130. The algorithms 133 are performed by the controller 104. The amount of time that is determined can be based on some amount of water (e.g., 10 gallons, 22 gallons) that fills some volume of space toward the top end of the tank 195. Such an amount of water can be part of the stored data 134, can be part of a corresponding algorithm 133 and/or protocol 132, can be dictated by a user 150, or established in some other way. In certain example embodiments, the controller 104 communicates the results of the algorithm 133 to a user 150.

The water heater 190 can operate in one of a number of modes. Examples of such modes can include, but are not limited to, a start-up mode, a standby mode, a transient mode, and a normal operating mode. When determining the amount of water currently available in the tank 195 of the water heater 190, the mode of operation of the water heater 190 is not relevant. When step 343 is complete, the process can conclude at the END step.

In step 344, a determination is made as to whether the temperature measurement toward the bottom end of the tank 195 exceeds a set point value (a type of threshold value). The determination can be made by the controller 104 using one or more protocols 132 and/or algorithms 133 stored in the storage repository 130. The set point value can be part of the stored data 134 of the storage repository 130. The set point value can be some minimum temperature at which the water toward the bottom end of the tank 195 can be considered heated water. The set point value corresponding to upper temperature sensor 158-1 (e.g., toward the top end of the tank 195) and the set point value corresponding to the lower temperature sensor 158-2 (e.g., toward the bottom end of the tank 195) may or may not be the same value. If the temperature measurement toward the bottom end of the tank 195 equals or exceeds the set point value, then the process proceeds to step 345. If the temperature measurement toward the bottom end of the tank 195 does not at least equal the set point value, then the process proceeds to step 346.

In step 345, a communication can be dispatched to state that the tank 195 is full of heated water that is available for immediate use. The controller 104 can perform the communication, which can be sent to a user 150. The controller 104 can also communicate the amount of heated water that is currently available. In such a case, the amount is equal to the actual capacity of the tank 195 of the water heater 190. When step 345 is complete, the process can conclude at the END step.

In step 346, one or more algorithms 133 are executed to determine how much heated water in the tank 195 is available for immediate use. These algorithms 133 calculate temperatures at multiple locations in the tank 195 between the upper temperature sensor 158-1 and the lower temperature sensor 158-2. Additionally, in certain optional embodiments, the results of these algorithms 133 can allow the controller 104 to communicate with a user 150 as to the amount of time it will take until the entire tank 195 has heated water. The algorithms 133 can be stored in the storage repository 130. The algorithms 133 are executed by the controller 104.

In certain example embodiments, the algorithms 133 used to determine how much heated water is in the tank 195 at a certain point in time can involve or be derived from regression analysis, centroid equations, and/or any other system of mathematical solutions. As such, historical data (e.g., from the same water heater 190, from other similar water heaters) can be used in the regression analysis. The regression analysis can be used to alter one or more algorithms 133 over time. These algorithms 133 can be dependent upon, or independent of, one or more factors related to the water heater 190, including but not limited to the capacity of the water heater (e.g., 40 gallons, 55 gallons), the amount of heated water recently drawn from the tank 195, and the type of water heater (e.g., electric, gas, heat pump).

As an example, if the algorithms 133 are designed to calculate the temperature at three points within the tank 195 spaced equidistantly between the location of the upper temperature sensor 158-1 and the lower temperature sensor 158-2, those temperatures can be calculated by the following algorithms 133:

$$T3=C1\times(UP-LP)+C2, \quad \text{Equation (1):}$$

where UP is the temperature measured by the upper temperature sensor 158-1, LP is the temperature measured by the lower temperature sensor 158-2, C1 is calculated according to equation (4) below, and C2 is calculated according to equation (5) below. In this case, the location of T3 in the tank 195 is closest to, but below than, the location of the upper temperature sensor 158-1.

$$T4=C3\times(UP-LP)+C4, \quad \text{Equation (2):}$$

where UP is the temperature measured by the upper temperature sensor 158-1, LP is the temperature measured by the lower temperature sensor 158-2, C3 is calculated according to equation (6) below, and C4 is calculated according to equation (7) below. In this case, the location of T4 in the tank 195 is between the location of T3 and the location of TS.

$$TS=CS\times(UP-LP)+C6, \quad \text{Equation (3):}$$

where UP is the temperature measured by the upper temperature sensor 158-1, LP is the temperature measured by the lower temperature sensor 158-2, CS is calculated according to equation (8) below, and C6 is calculated according to equation (9) below. In this case, the location of TS in the tank 195 is closest to, but higher than, the location of the lower temperature sensor 158-2.

$$C1=-0.0002\times SP^2+0.0625\times SP-4.953, \quad \text{Equation (4):}$$

where SP is the set $$C2=0.0133\times SP^2-2.6375\times SP+246.84, \quad \text{Equation (5):}$$

where SP is the set $$C3=0.0002\times SP^2+0.0456\times SP-3.8334, \quad \text{Equation (6):}$$

where SP is the set $$C4=0.0121\times SP^2-2.3305\times SP+227.09 \quad \text{Equation (7):}$$

where SP is the set $$CS=0.0001\times SP^2+0.0322\times SP-2.9648, \quad \text{Equation (8):}$$

where SP is the set $$C6=0.009\times SP^2-1.4537\times SP+166.02, \quad \text{Equation (9):}$$

where SP is the set point temperature value.

In general, in this example, a calculated temperature at a location in the tank 195 can be calculated as a first value times a difference between the temperature measured at the upper temperature sensor 158-1 and the temperature measured at the lower temperature sensor 158-2, where this product is added to a second value. Each of the values in this case are quadratic equations where the set point value is the variable used to solve the respective quadratic equation. As stated above, the controller 104 can adjust these formulas from time to time based on user input, historical information, actual measurements, and/or other factors.

In step 347, a determination is made as to the highest location in the tank 195 where the calculated temperature falls below the set point value. In some cases, the set point value is reduced by an offset. The determination is made by the controller 104. For example, continuing with the example above, the controller 104 may first determine whether the calculated value of T3 is greater than or equal to the set point value less an offset. If not, then the controller 104 determines that 25% of the tank 195 has heated water at that point in time.

If, on the other hand, the controller 104 determines that the calculated value of T3 is greater than or equal to the set point value less an offset, then the controller 104 next determines whether the calculated value of T4 is greater than or equal to the set point value less an offset. If not, then the controller 104 determines that 44% of the tank 195 has heated water at that point in time. Otherwise, if the controller 104 determines that the calculated value of T4 is greater than or equal to the set point value less an offset, then the controller 104 determines whether the calculated value of TS is greater than or equal to the set point value less an offset. If not, then the controller 104 determines that 63% of the tank 195 has heated water at that point in time. On the other hand, if the controller 104 determines that the calculated value of TS is greater than or equal to the set point value less an offset, then the controller 104 determines that 82% of the tank 195 has heated water at that point in time.

In step 348, a communication can be dispatched to state the amount of heated water in the tank 195 based on the results of step 347. For instance, in the example described above, the communication states that the tank 195 has an amount (e.g., 63% of capacity of the tank 195, 33 gallons) of heated water that corresponds to the lowest location in the tank 195 where the calculated temperature equals the set point temperature value (in some cases, less an offset). The controller 104 can perform the communication, which can be sent to a user 150. When step 348 is complete, the process can conclude at the END step.

The method 340 of FIG. 3 can be performed based on one or more factors and/or events. For example, the controller 104 can continuously determine how much heated water is in the tank 195 at a given time, and this information can be communicated to a user 150. As another example, the controller 104 can determine how much heated water is in the tank 195 at discrete moments in time (e.g., every hour, every four hours). As yet another example, the controller 104 can determine how much heated water is in the tank 195 immediately after the occurrence of an event (e.g., an amount of heated water is drawn from the tank 195). [0120] The method 460 of FIG. 4 describes how example embodiments can provide a time estimate to meet a volume request for heated water from a water heater 190. The example method 460 of FIG. 4 begins at the START step and proceeds to step 461, where a request for heated water is received. The request can be made by a user 150 to the controller 104. The request can be a direct request (e.g., a request made through a mobile app for a specific amount of heated water) from a user 150. If the user 150 is an appliance or process that uses heated water, then the user 150 can also communicate requests directly to the controller 104. For example, if a faucet (a form of a user 150) for a showerhead is turned on, the controller can determine, based on historical usage, how much heated water should be required. As another example, if a dishwasher (another form of a user 150) is about to operate, the controller 104 can determine, based on the setting selected, manufacturer's data, historical usage, and/or other information associated with the dishwasher, how much heated water should be required. As yet another example, if a clothes washer (yet another form of a user 150) is about to operate, the controller 104 can determine, based on the setting selected, manufacturer's data, historical usage, and/or other information associated with the clothes washer, how much heated water should be required.

When a user 150 is an appliance or other process that uses heated water, then such appliance, process, or associated component can be configured to use communication links 105 (e.g., wired and/or wireless technology) to communicate with the controller 104. In any case, the controller 104 can communicate with any type of user 150 (e.g., appliances, smart phones) and can estimate, based on sensor 151 measurements (e.g., from temperature sensor 158-1 and temperature sensor 158-2) and/or stored data 134 (e.g., manufacturer's settings, historical usage), how much water is required for the various processes. The request can be received by the controller 104 using the application interface 126.

In step 462, the amount of heated water (i.e., water that exceeds a mm1mum temperature threshold value) currently in the tank 195 is determined. This determination can be made by the controller 104 using one or more algorithms 133 and/or protocols 132. The determination can also be made by the controller 104 using one or more measurements of one or more parameters (e.g., temperatures) made by one or more sensor devices 151 (e.g., temperature sensor 158-1, temperature sensor 158-2). In some cases, any measurements made by a sensor device 151 can be based on instructions received by the sensor device 151 from the controller 104. Alternatively, measurements made by a sensor device 151 can be made continuously and continuously available to the controller 104. Once the one or more parameters are measured, the corresponding sensor device 151 can send the measurements to the controller 104. In certain example embodiments, the amount of heated water currently available in the tank 195 is determined using at least some of the method 340 discussed above with respect to FIG. 3.

In step 463, a determination is made as to whether the amount of heated water in the tank 195 is sufficient to meet the request of step 461. The determination can be made by the controller 104 by comparing the amount requested in step 461 with the amount calculated in step 462. If the amount of heated water in the tank 195 is sufficient to meet the request, then the process proceeds to step 466. If the amount of heated water in the tank 195 is not sufficient to meet the request, then the process proceeds to step 464.

In step 464, one or more algorithms 133 are performed to determine how long it will take until the tank 195 has the amount of heated water needed to meet the request. The algorithms 133 can be stored in the storage repository 130. The algorithms 133 are performed by the controller 104. The determination can be based, at least in part, on the temperature measured by the temperature sensors 158-1 and 158-2. The algorithms 133 used to perform step 464 can be the same as, or derived from, the algorithms used in step 462. In some cases, the amount of time needed to heat water in the tank 195 can vary, depending, for example, on whether the water heater 190 is in start-up mode (e.g., was just installed, the heating system 170 just resumed operation after an extended period of time where operations were suspended), in a transient mode (e.g., some quantity of heated water was just drawn out of the tank 195), in standby mode, or in some other mode of operation. If the water heater 190 in question has multiple modes of operation, then information as to which mode of operation is active at the time is provided to help determine how long it will take until the tank 195 has the amount of heated water needed to meet the request.

As an example, a protocol 132 can require that the controller 104 determine whether the temperature measured by the upper temperature sensor 158-1 in the tank 195 is equal to or greater than the set point value. If not, the controller 104 can calculate the amount of energy needed to heat the water in the tank 195 so that the tank 195 is full of heated water, and the amount of time to do so, using the following algorithms 133:

$$Q1 = A \times \text{Capacity of tank} \times (T1 - T2), \qquad \text{Equation (10):}$$

where A is a constant that represents the amount of heat energy needed to raise one pound of water in the tank 195 by 1° P (assumed to be 8.33 BTU/gal, but can be a different value for a different fluid or for water having salt or other elements added to it), T1 is the mean average of the measured and calculated temperatures in the tank 195 at a time just after the heating system 170 turns off (is satisfied), and T2 is the measured temperature of unheated water entering the tank 195 (e.g., as measured by optional temperature sensor 158-3, as measured by the lower temperature sensor 158-2).

$$\text{Time} = Q1/Q2, \qquad \text{Equation (11):}$$

where Q1 is the result of equation (10), and Q2 is the heating capacity of the heating system 170 for the tank 195.

If the controller 104 determines that the temperature measured by the upper temperature sensor 158-1 in the tank 195 is equal to or greater than the set point value, a protocol 132 can require that the controller 104 next 104 determine whether the temperature measured by the lower temperature sensor 158-2 in the tank 195 is equal to or greater than the set point value. If not, the controller 104 can calculate the amount of energy needed to heat the water in the tank 195 so that the tank 195 is full of heated water, and the amount of time to do so, using the following algorithms 133:

$$Q3 = A \times \text{Capacity of tank} \times (T1 - T3), \qquad \text{Equation (12):}$$

where A is a constant that represents the amount of heat energy needed to raise one pound of water in the tank 195 by 1° P (assumed to be 8.33 BTU/gal, but can be a different value for a different fluid or for water having salt or other elements added to it), Ti is the mean average of the measured and calculated temperatures in the tank 195 at a time just after the heating system 170 turns off (is satisfied), and T3 is the sum of 2 times the set point value and the calculated temperatures within the tank 195, where the sum is divided by the sum of temperature sensors in the tank 195 and calculated temperature points in the tank 195.

$$\text{Time} = Q3/Q2, \qquad \text{Equation (13):}$$

where Q3 is the result of equation (12), and Q2 is the heating capacity of the heating system 170 for the tank 195.

If the controller 104 determines that the temperature measured by the lower temperature sensor 158-2 in the tank 195 is equal to or greater than the set point value, then the controller 104 determines that the tank 195 is already full of heated water.

In step 465, a communication is sent as to when the tank 195 will have sufficient heated water to meet the request. The controller 104 can generate and send the communication to a user 150. Once step 465 is complete, the method 460 can revert to one of the previously-described steps (e.g., step 461). Alternatively, when step 465 is complete, then the method 460 can end at the END step.

In step 466, a communication is sent that the tank 195 currently has sufficient heated water to meet the request. The controller 104 can generate and send the communication to a user 150. Once step 466 is complete, the method 460 can revert to one of the previously-described steps (e.g., step 461). Alternatively, when step 466 is complete, then the method 460 can end at the END step.

Figure 5A:
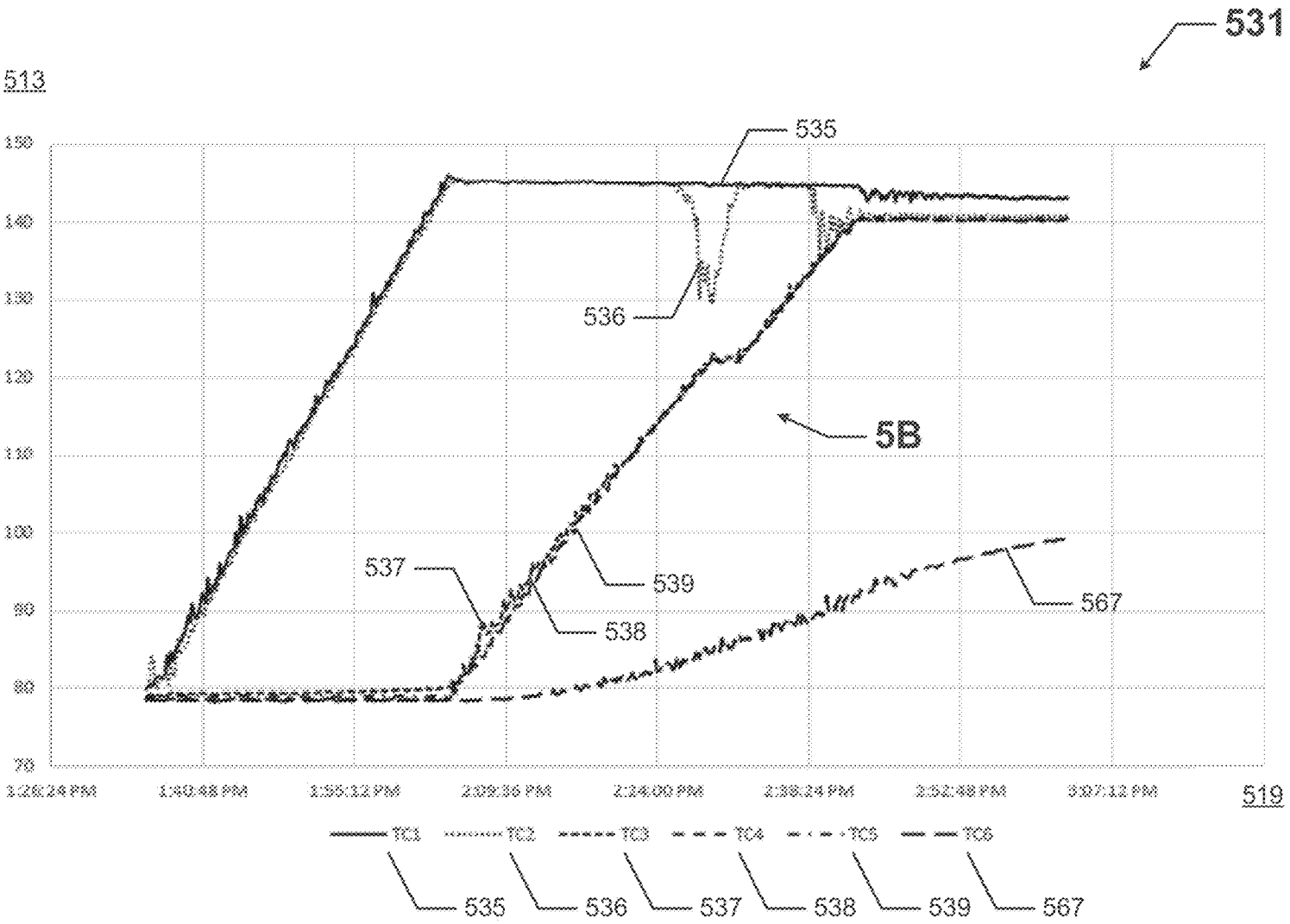
FIGS. 5A and 5B show graphs of temperature plots over time for a 40 gallon water heater in accordance with certain example embodiments.
Figure 5B:
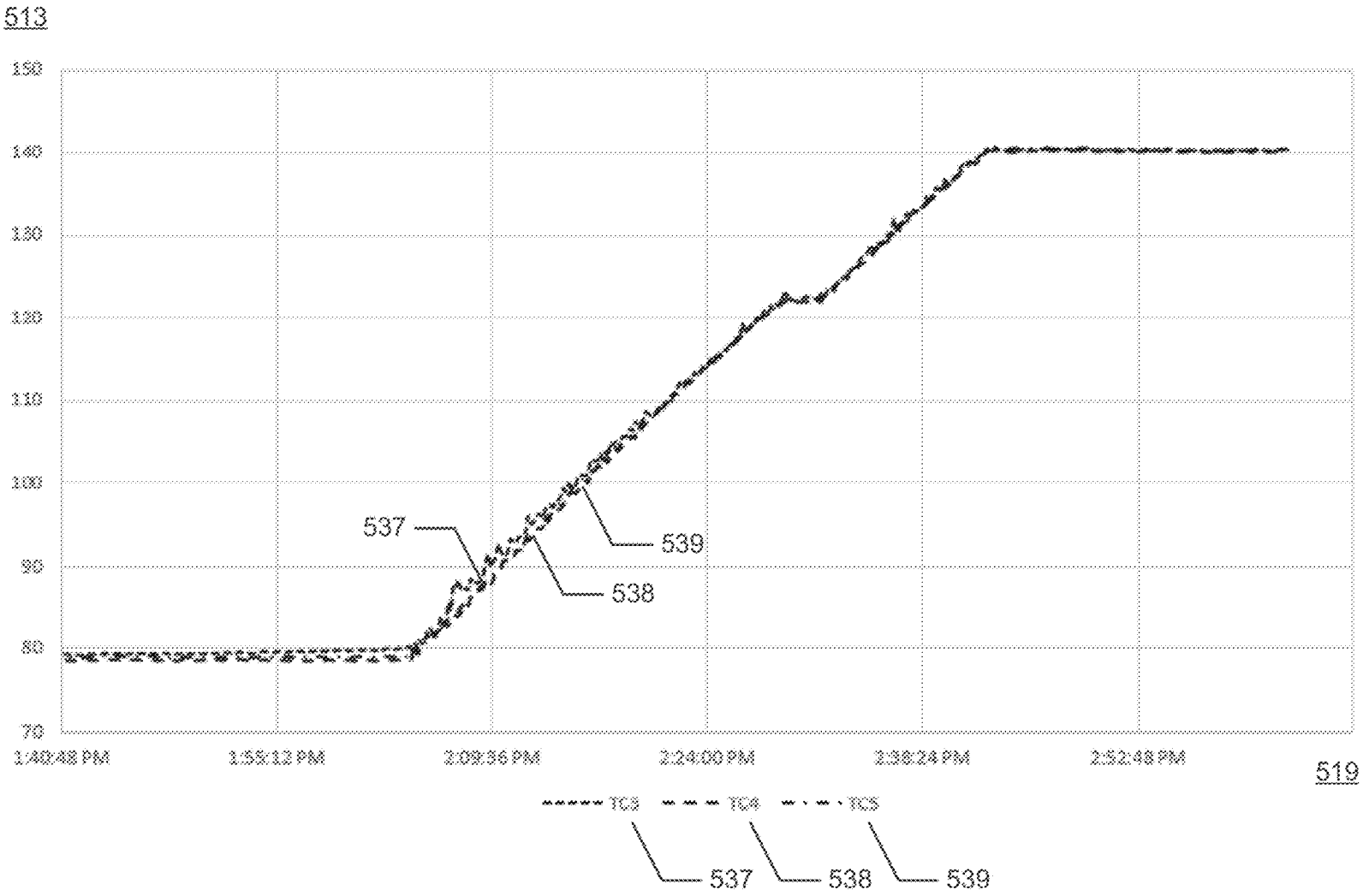
Figure 6A:
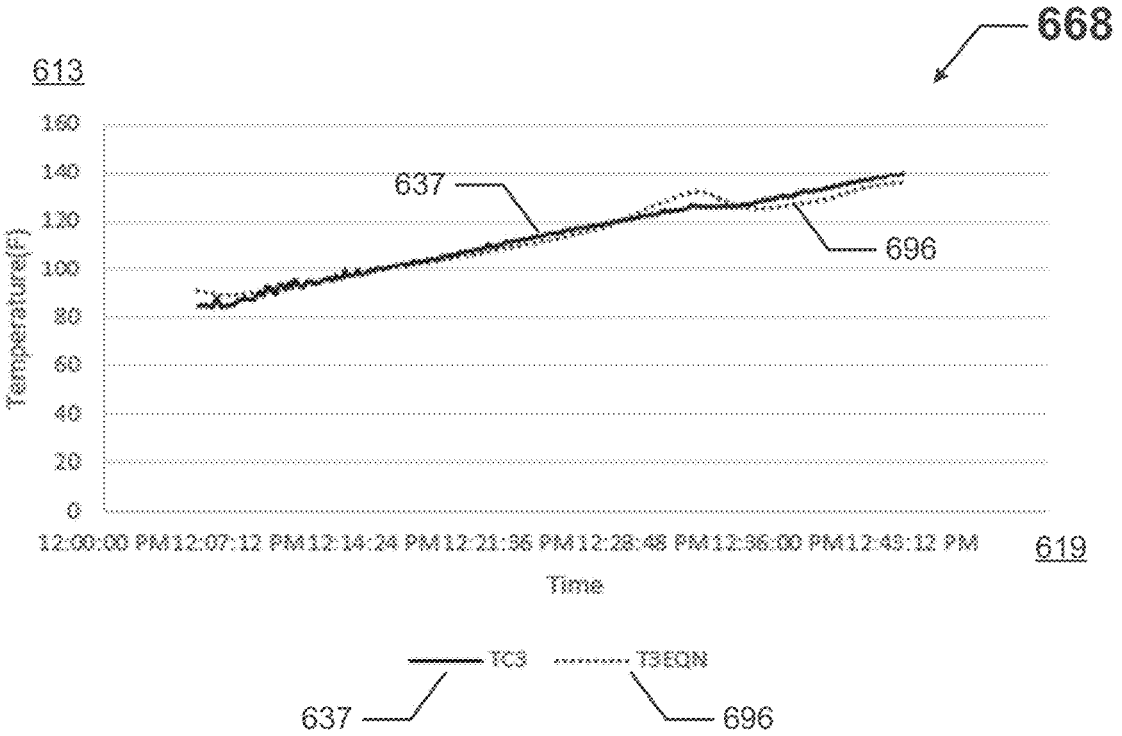
FIGS. 6A through 6C show graphs of actual versus forecast temperatures for the 40 gallon water heater of FIGS. 5A and 5B.
Figure 6B:
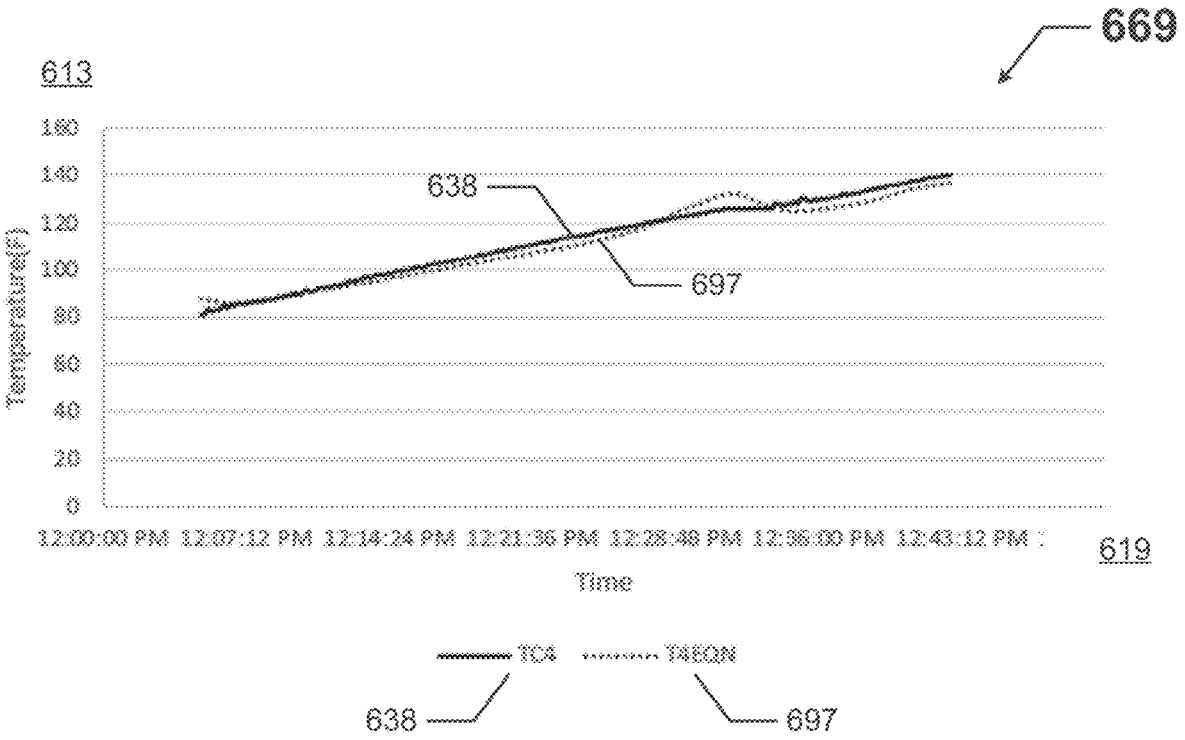
Figure 6C:
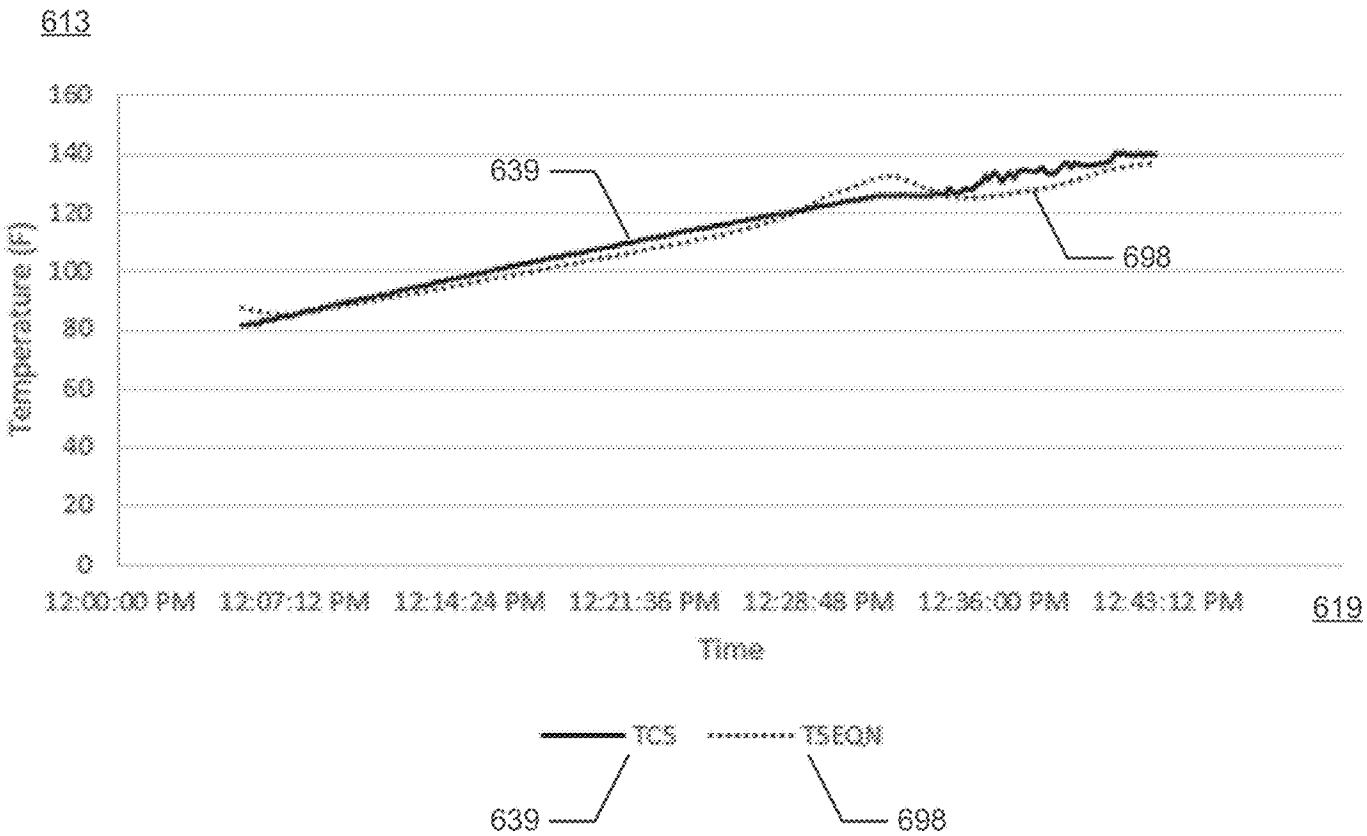
Figure 7A:
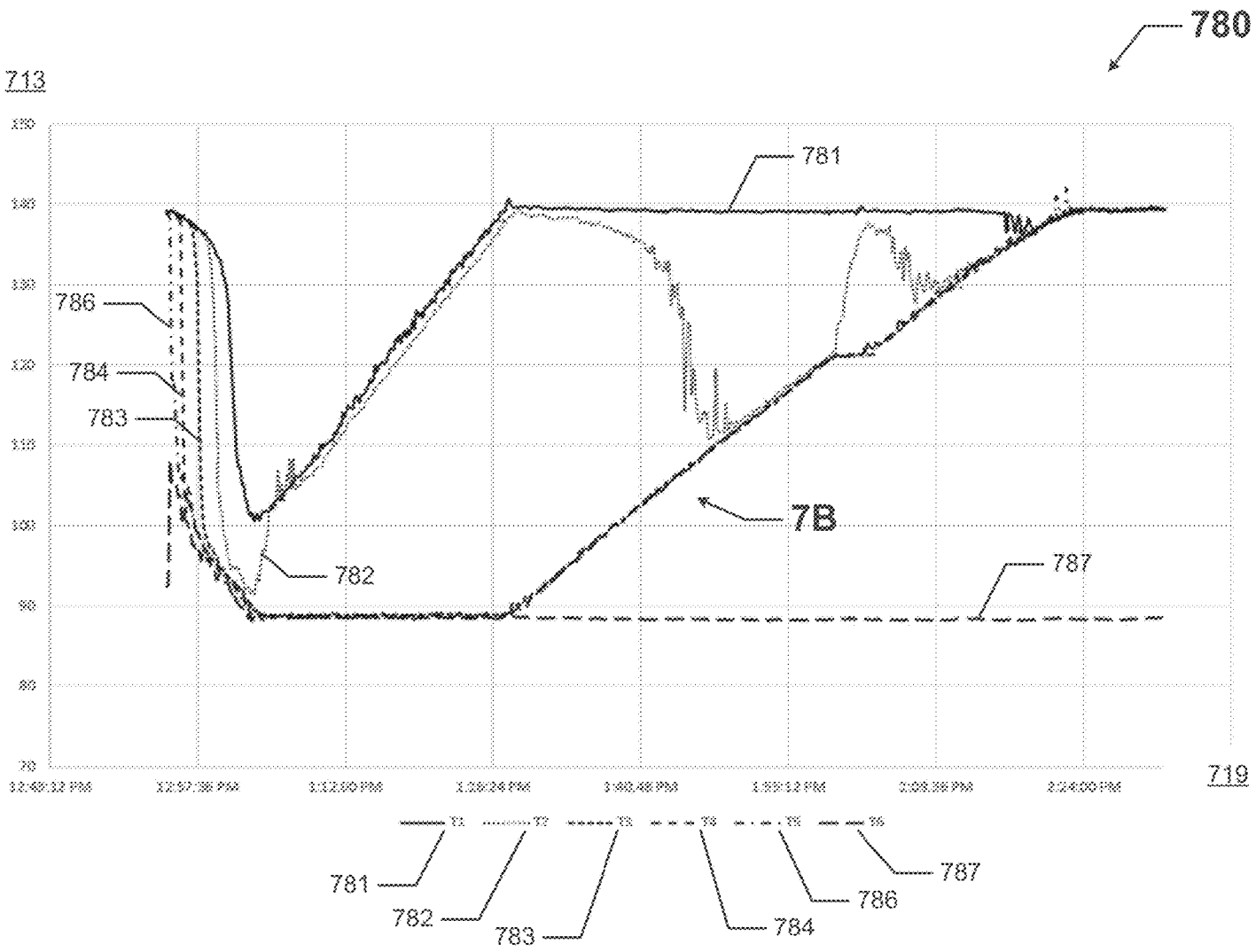
FIGS. 7A and 7B show graphs of temperature plots over time for a 55 gallon water heater in accordance with certain example embodiments.
Figure 7B:
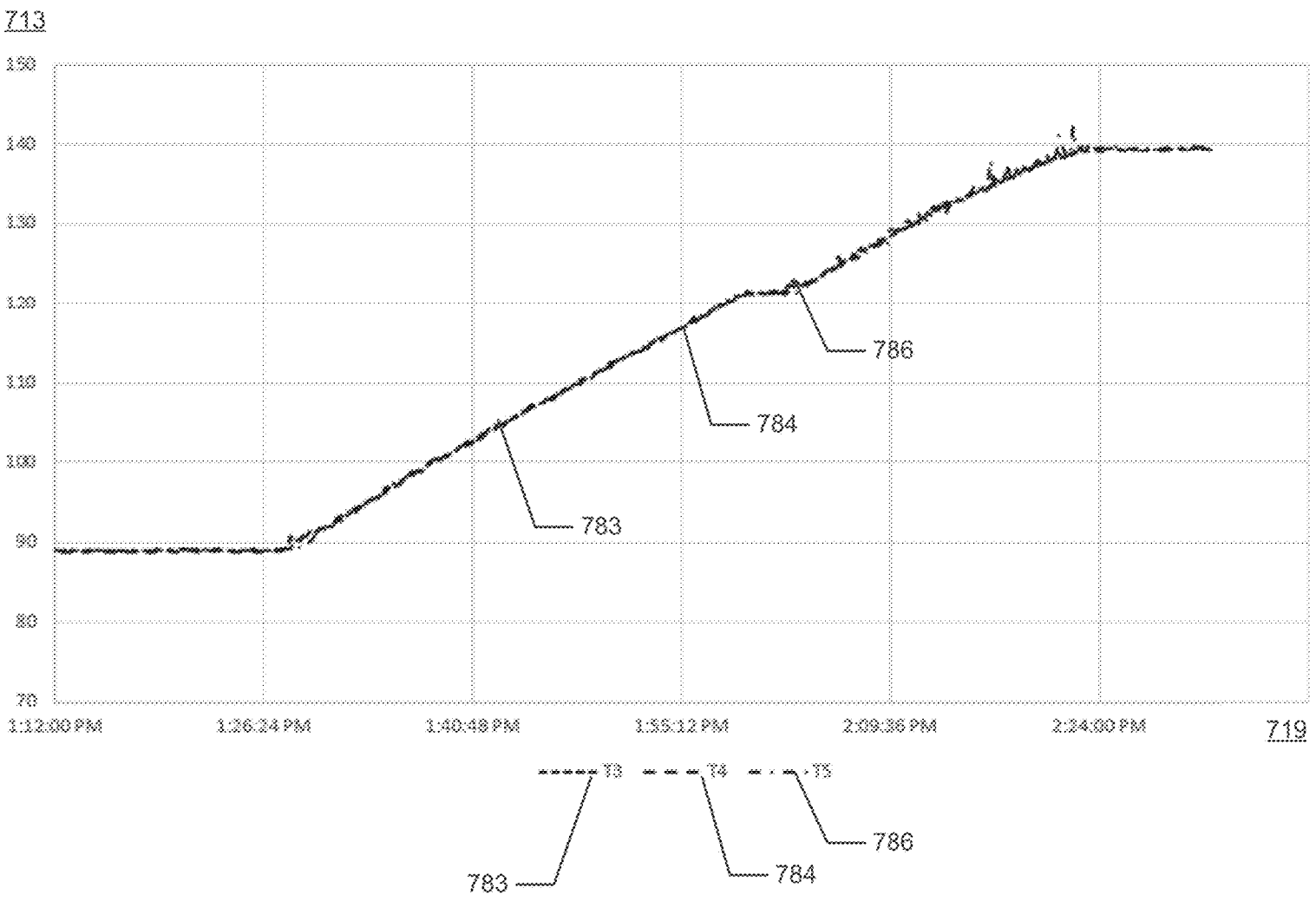
Figure 8A:
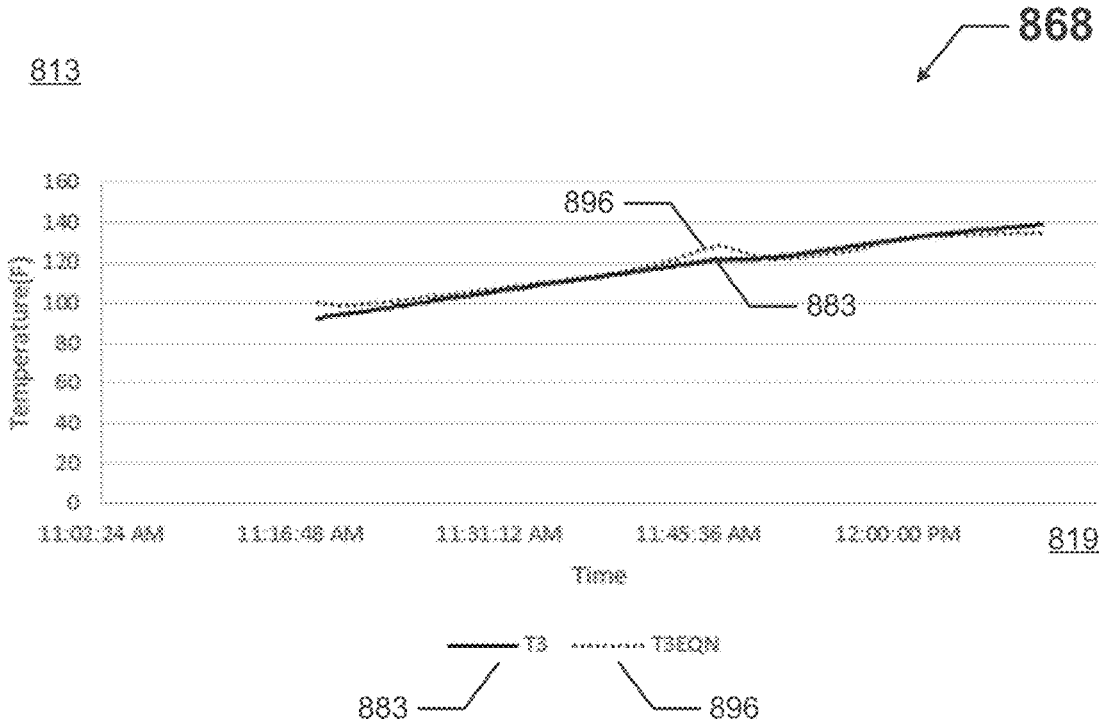
FIGS. 8A through 8C show graphs of actual versus forecast temperatures for the 40 gallon water heater of FIGS. 7A and 7B.
Figure 8B:
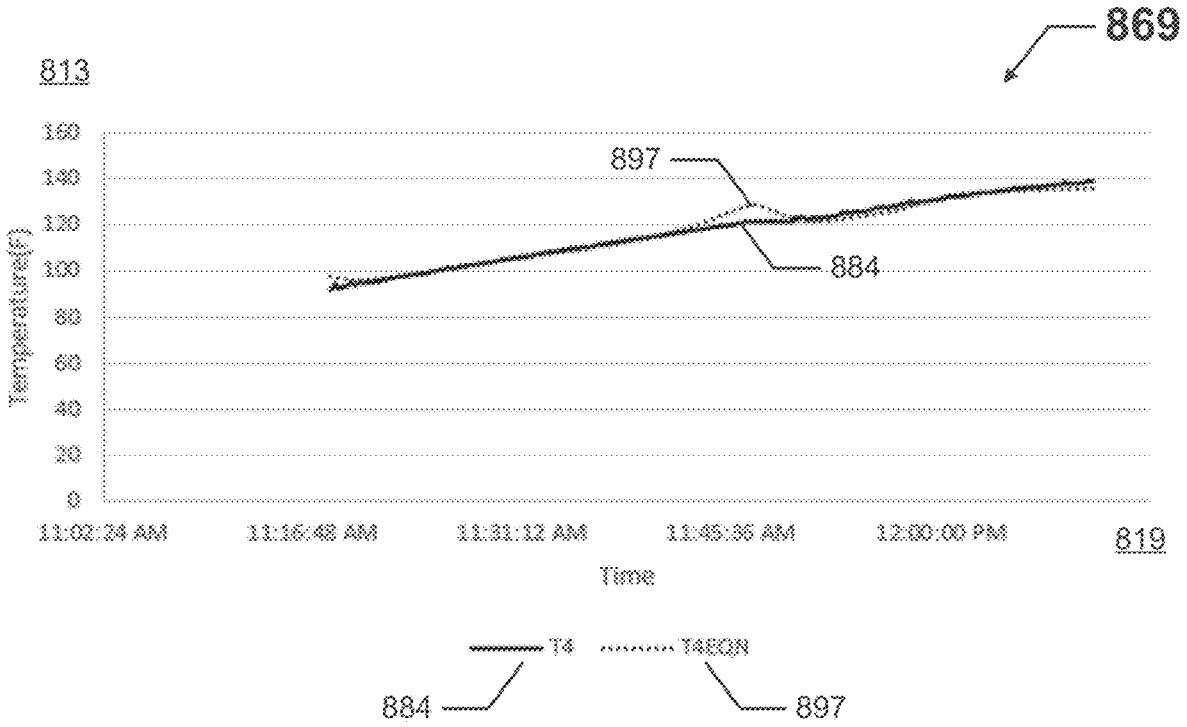
Figure 8C:
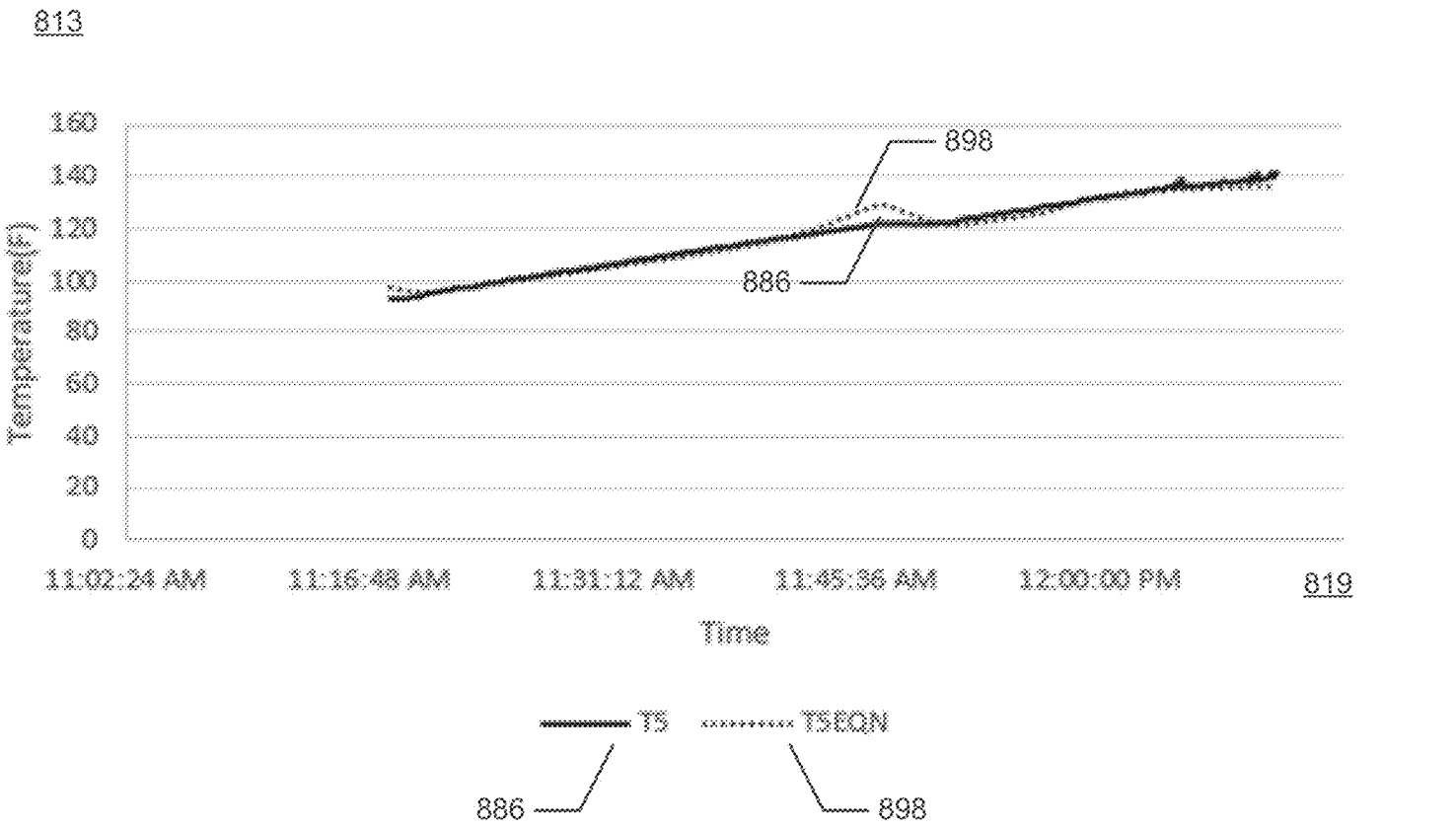

As discussed above, the algorithms 133 used to determine how much heated water is in the tank 195 of the water heater 190 can be developed over time using regression analysis. FIGS. 5A through 7B show various graphs plotting data that leads to the refinement of the algorithms 133 used to accurately calculate temperatures at various locations in the tank 195 without having temperature sensors at those locations. FIGS. 5A and 5B show graphs 531 of temperature plots 513 over time 519 for a 40 gallon water heater 190 in accordance with certain example embodiments. FIGS. 6A through 6C show graphs of actual versus forecast temperatures for the 40 gallon water heater of FIGS. 5A and 5B. FIGS. 7A and 7B show graphs 780 of temperature plots 713 over time 719 for a 55 gallon water heater 190 in accordance with certain example embodiments. FIGS. 8A through 8C show graphs of actual versus forecast temperatures for the 40 gallon water heater of FIGS. 7A and 7B.

Referring to FIGS. 1 through 7B, the graph 531 of FIG. 5A shows actual temperature measurements made by 6 temperature sensors disposed along the height of a tank 195 of a water heater 190 having a 40 gallon capacity. TC1 535 corresponds to a first temperature sensor disposed toward a top end of the tank 195. TC2 536 corresponds to a second temperature sensor disposed below the temperature sensor for TC1. TC3 537 corresponds to a third temperature sensor disposed below the temperature sensor for TC2. TC4 538 corresponds to a fourth temperature sensor disposed below the temperature sensor for TC3. TC5 539 corresponds to a fifth temperature sensor disposed below the temperature sensor for TC4. TC6 567 corresponds to a sixth temperature sensor disposed below the temperature sensor for TC5 toward the bottom of the tank 190.

The plots in the graph 531 of FIG. 5A show that measurements for all six temperature sensors are taken almost continuously over an approximately 90 minute period. The beginning of this period can correspond, for example, to a time when some amount (e.g., 20 gallons) of water was just drawn from the tank 195. These temperature measurements can be used, at least in part, to perform a regression analysis that establishes algorithms 133, such as equations 1 through 9 shown above, to provide calculated values for temperatures at various points along the height of the tank 195 of the water heater 190. These calculated temperature values, in turn, can be used to estimate the amount of heated water available in the tank 195. The graph of FIG. 5B shows a detail for the plots of TC3 537, TC4 538, and TC5 539 from FIG. 5A for a subset of time relative to what is shown in FIG. 5A.

FIGS. 6A through 6C graphically show how accurately the example algorithms used herein calculate temperatures 613 at different heights in the tank 195 over time 619. Specifically, the graph 668 of FIG. 6A plots actual temperature TC3 637 measured by a temperature measuring device at a first location in a tank 195 versus a calculated temperature 696 at the first location in the tank 195 using one or more algorithms according to example embodiments. Similarly, the graph 669 of FIG. 6B plots actual temperature TC3 638 measured by a temperature measuring device at a second location in a tank 195 versus a calculated temperature 697 at the second location in the tank 195 using one or more algorithms according to example embodiments. Finally, the graph 688 of FIG. 6C plots actual temperature TC3 639 measured by a temperature measuring device at a third location in a tank 195 versus a calculated temperature 698 at the third location in the tank 195 using one or more algorithms according to example embodiments.

The graph 780 of FIG. 7A shows actual temperature measurements made by 6 temperature sensors disposed along the height of a tank 195 of a water heater 190 having a 55 gallon capacity. TC1 781 corresponds to a first temperature sensor disposed toward a top end of the tank 195. TC2 782 corresponds to a second temperature sensor disposed below the temperature sensor for TC1. TC3 783 corresponds to a third temperature sensor disposed below the temperature sensor for TC2. TC4 784 corresponds to a fourth temperature sensor disposed below the temperature sensor for TC3. TC5 786 corresponds to a fifth temperature sensor disposed below the temperature sensor for TC4. TC6 787 corresponds to a sixth temperature sensor disposed below the temperature sensor for TC5 toward the bottom of the tank 190.

The plots in the graph 780 of FIG. 7A show that measurements for all six temperature sensors are taken almost continuously over an approximately 105 minute period. The beginning of this period can correspond, for example, to a time when some amount (e.g., 20 gallons) of water was just drawn from the tank 195, and then shortly thereafter more water is withdrawn for a brief period of time. These temperature measurements can be used, at least in part, to perform a regression analysis that establishes algorithms 133, such as equations 1 through 9 shown above, to provide calculated values for temperatures at various points along the height of the tank 195 of the water heater 190. These calculated temperature values, in turn, can be used to estimate the amount of heated water available in the tank 195. The graph of FIG. 7B shows a detail for the plots of TC3 783, TC4 784, and TC5 786 from FIG. 7A for a subset of time relative to what is shown in FIG. 7A FIGS. 8A through 8C graphically show how accurately the example algorithms used herein calculate temperatures 813 at different heights in the tank 195 over time 819. Specifically, the graph 868 of FIG. 8A plots actual temperature TC3 883 measured by a temperature measuring device at a first location in a tank 195 versus a calculated temperature 896 at the first location in the tank 195 using one or more algorithms according to example embodiments. Similarly, the graph 869 of FIG. 8B plots actual temperature TC3 884 measured by a temperature measuring device at a second location in a tank 195 versus a calculated temperature 897 at the second location in the tank 195 using one or more algorithms according to example embodiments. Finally, the graph 888 of FIG. 8C plots actual temperature TC3 886 measured by a temperature measuring device at a third location in a tank 195 versus a calculated temperature 898 at the third location in the tank 195 using one or more algorithms according to example embodiments.

Example embodiments can determine the supply of hot water (also called heated water herein) in a water heater. This determination can be performed in real time for a current amount or a future amount. In the case of determining a future amount, an amount of time may also be estimated using example embodiments. Example embodiments can receive input and/or information from any of a number of sensor devices and/or users to make its determinations. Example embodiments can also provide a determination as to whether there is sufficient heated water for a process that is about to be used by a user. Example embodiments can control various aspects of a water heater to optimize energy efficiency and reduce energy consumption. Example embodiments can also lower costs and increase the useful life of a water heater, including its various components.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A water heating system comprising:
a tank;
a first temperature sensor configured to measure a first temperature of water at a first location in the tank;
a second temperature sensor configured to measure a temperature of water at a second location in the tank, the second location being different from the first location; and
a controller configured to:
receive first temperature data from the first temperature sensor and second temperature data from the second temperature sensor;
determine a calculated temperature for water at a third location in the tank based at least in part on the first temperature data and the second temperature data, the third location being different from the first location and the second location;
determine an amount of heated water in the tank based at least in part on the first temperature data, the second temperature data, and the calculated temperature for water at the third location; and
output instructions for one or more components of the water heating system to increase the amount of heated water to a predetermined value if the amount of heated water in the tank is below a threshold value.

2. The water heating system of claim 1, wherein determining the calculated temperature for water at the third location is further based at least in part on a plurality of algorithms.

3. The water heating system of claim 1, wherein the third location is between the first location and the second location.

4. The water heating system of claim 3, wherein the first location corresponds to a first height, the second location corresponds to a second height that is less than the first height, and the third location corresponds to a third height that is less than the first height and greater than the second height.

5. The water heating system of claim 3, wherein the third location is spaced substantially equidistantly between the first location and the second location along a height of the tank.

6. The water heating system of claim 1, wherein the controller is further configured to:
determine, based at least in part on the first temperature data and the second temperature data, a first calculated temperature for water at a third location in the tank, a second calculated temperature for water at a fourth location in the tank, and a third calculated temperature for water at a fifth location in the tank, each of the third, fourth, and fifth locations being between the first location and the second location,
wherein determining the amount of heated water in the tank is further based at least in part on the first calculated temperature for water at the third location, the second calculated temperature for water at the fourth location, and the third calculated temperature for water at the fifth location.

7. The water heating system of claim 1, wherein the controller is configured to determine the amount of heated water in the tank irrespective of information indicating a capacity of the tank.

8. The water heating system of claim 1, wherein the controller is configured to determine the amount of heated water in the tank irrespective of information indicating a flow rate of water entering or exiting the tank.

9. The water heating system of claim 1 further comprising a heating system configured to provide heat to water in the tank,
wherein the controller is further configured to:
control operation of the heating system;
disengage the heating system if the first temperature data or the second temperature data indicates a temperature that exceeds a maximum temperature threshold.

10. The water heating system of claim 1, wherein the controller is configured to determine the amount of heated water in the tank periodically.

11. The water heating system of claim 1, wherein the controller is configured to determine the amount of heated water in the tank after a quantity of water flows out of the tank.

12. The water heating system of claim 1, wherein determining the amount of heated water in the tank is further based at least in part on a temperature set point.

13. A non-transitory computer-readable medium having instructions stored thereon that, when executed by a processor, cause a controller to:
receive first temperature data from a first temperature sensor, the first temperature data being indicative of a temperature of water at a first location in a tank of a water heater;
receive second temperature data from a second temperature sensor, the second temperature data being indicative of a temperature of water at a second location in the tank, the second location being different from the first location;
determine a calculated temperature for water at a third location in the tank based at least in part on the first temperature data and the second temperature data, the third location being different from the first location and the second location;

determine an amount of heated water in the tank based at least in part on the first temperature data, the second temperature data, and the calculated temperature for water at the third location; and output instructions for one or more components of the water heater to increase the amount of heated water to a predetermined value if the amount of heated water in the tank is below a threshold value.

14. The non-transitory computer-readable medium of claim 13, wherein determining the calculated temperature for water at the third location is further based at least in part on a plurality of algorithms.

15. The non-transitory computer-readable medium of claim 13, wherein the third location is between the first location and the second location.

16. The non-transitory computer-readable medium of claim 15, wherein the first location corresponds to a first height, the second location corresponds to a second height that is less than the first height, and the third location corresponds to a third height that is less than the first height and greater than the second height.

17. The non-transitory computer-readable medium of claim 15, wherein the third location is spaced substantially equidistantly between the first location and the second location along a height of the tank.

18. The non-transitory computer-readable medium of claim 13, wherein the instructions, when executed by the processor, further cause the controller to:

determine, based at least in part on the first temperature data and the second temperature data, a first calculated temperature for water at a third location in the tank, a second calculated temperature for water at a fourth location in the tank, and a third calculated temperature for water at a fifth location in the tank, each of the third, fourth, and fifth locations being between the first location and the second location, wherein determining the amount of heated water in the tank is further based at least in part on the first calculated temperature for water at the third location, the second calculated temperature for water at the fourth location, and the third calculated temperature for water at the fifth location.

19. The non-transitory computer-readable medium of claim 13, wherein instructions, when executed by the processor, cause the controller to determine the amount of heated water in the tank irrespective of information indicating a capacity of the tank and irrespective of information indicating a flow rate of water entering or exiting the tank.

20. The non-transitory computer-readable medium of claim 13, wherein the instructions, when executed by the processor, further cause the controller to:

determine that the amount of heated water in the tank is below the threshold value; and determine an amount of time required to produce additional heated water to meet the threshold value.

* * * * *